US012607006B2

(12) United States Patent
Espinosa

(10) Patent No.: US 12,607,006 B2
(45) Date of Patent: Apr. 21, 2026

(54) ANCHOR FOR CONNECTING TO A ROD

(71) Applicant: CETRES HOLDINGS, LLC, Jackson, WY (US)

(72) Inventor: Thomas M. Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 213 days.

(21) Appl. No.: 17/555,673

(22) Filed: Dec. 20, 2021

(65) Prior Publication Data

US 2022/0195718 A1 Jun. 23, 2022

Related U.S. Application Data

(60) Provisional application No. 63/130,133, filed on Dec. 23, 2020.

(51) Int. Cl.
*E04B 1/41* (2006.01)
*E04C 5/06* (2006.01)

(52) U.S. Cl.
CPC ..... *E04B 1/4121* (2013.01); *E04C 5/0645* (2013.01)

(58) Field of Classification Search
CPC ..... E04B 1/41; E04B 1/4114; E04B 1/4121; E04B 1/4157; E04B 1/4164; E04C 5/0645; E04C 5/12; E04C 5/165; E04C 5/167; E04C 5/168; E04G 21/185; F16B 7/182; E04H 9/027; E04H 9/14
See application file for complete search history.

(56) References Cited

U.S. PATENT DOCUMENTS 461,562 A * 10/1891 Ball ..... F16B 7/182 191/44.1
1,656,797 A * 1/1928 Scott ..... H01R 4/56 403/301
3,791,751 A * 2/1974 Vey ..... F16C 3/00 403/311
3,969,032 A * 7/1976 Wolicki ..... B23K 9/0026 403/310
4,007,564 A * 2/1977 Chisholm ..... E04H 12/22 403/186
4,010,629 A * 3/1977 Wolicki ..... B23K 9/0026 72/368
5,746,555 A * 5/1998 McEvoy ..... F16B 7/182 411/14
D422,200 S * 4/2000 Maruyama ..... D8/382
(Continued)

FOREIGN PATENT DOCUMENTS

CN 112854474 A * 5/2021 ..... E04B 1/4114
KR 102345040 B1 * 12/2021 ..... F16B 13/06
(Continued)

*Primary Examiner* — Ryan D Kwiecinski
(74) *Attorney, Agent, or Firm* — FRESH IP PLC

(57) ABSTRACT

An anchor includes a body having a first end and a second end; the body having a side wall between the first end and the second end; the body including an axial hole extending from the first end into the body, the axial hole for receiving an end portion of a rod; and the body including a first longitudinal cutout extending into the side wall to create a first opening into a first portion of the axial hole to expose an end portion of the rod to be inserted in the axial hole to be welded to the body.

19 Claims, 19 Drawing Sheets

(56) References Cited

U.S. PATENT DOCUMENTS

| | | | | |
|---|---|---|---|---|
| 6,851,245 | B1 * | 2/2005 | Abukawa | E04C 5/165 403/361 |
| 6,951,078 | B2 | 10/2005 | Espinosa | |
| D583,224 | S | 12/2008 | Holdsworth | D8/382 |
| D605,499 | S * | 12/2009 | Gaudron | D8/349 |
| 7,762,030 | B2 | 7/2010 | Espinosa | |
| 7,985,041 | B2 * | 7/2011 | Lin | F16B 37/00 411/388 |
| 8,136,318 | B2 | 3/2012 | Espinosa | |
| 8,943,777 | B2 | 2/2015 | Espinosa | |
| 9,062,452 | B2 * | 6/2015 | Espinosa | E04B 1/4121 |
| 9,097,000 | B2 | 8/2015 | Espinosa | |
| 9,097,001 | B2 * | 8/2015 | Espinosa | E04B 1/2604 |
| 9,222,251 | B2 * | 12/2015 | Espinosa | E04B 1/4128 |
| 9,416,530 | B2 | 8/2016 | Espinosa | |
| 9,874,009 | B2 * | 1/2018 | Espinosa | E04B 1/4157 |
| D813,023 | S * | 3/2018 | Reigstad | D8/382 |
| D889,950 | S * | 7/2020 | Dill | D15/21 |
| 11,137,008 | B2 * | 10/2021 | Dill | F16B 13/003 |
| 2008/0314112 | A1 * | 12/2008 | Park | B21D 53/24 72/347 |
| 2021/0025419 | A1 * | 1/2021 | Espinosa | F16B 7/182 |

FOREIGN PATENT DOCUMENTS

| | | | | |
|---|---|---|---|---|
| WO | WO-2010090748 | A1 * | 8/2010 | E04C 5/0645 |
| WO | WO-2012129177 | A1 * | 9/2012 | B28B 23/0056 |
| WO | WO-2014190054 | A1 * | 11/2014 | E04B 1/4157 |
| WO | WO-2016179638 | A1 * | 11/2016 | E04B 5/36 |

* cited by examiner

ANCHOR FOR CONNECTING TO A ROD

RELATED APPLICATION

This is a nonprovisional application claiming the priority benefit of Provisional Application Ser. No. 63/130,133, filed Dec. 23, 2021, incorporated herein by reference.

FIELD OF THE INVENTION

The present invention is generally directed to hold down systems and particularly to anchors used in hold down systems.

BACKGROUND OF THE INVENTION

Hold down systems are used in reinforcing stud walls against tension or compression loads caused by earthquakes, hurricanes, windstorms, etc. Hold down systems use threaded rods anchored to the foundation and operably attached to walls. Examples of hold down systems are disclosed in U.S. Pat. Nos. 6,951,078, 7,762,030, 8,136,318, 8,943,777, 9,097,000, 9,097,001, 9,416,530 and 9,874,009, hereby incorporated by reference.

SUMMARY OF THE INVENTION

The present invention provides an anchor, comprising a body having a first end and a second end; the body having a side wall between the first end and the second end; the body including an axial hole extending from the first end into the body, the axial hole for receiving an end portion of a rod; and the body including a first longitudinal cutout extending into the side wall to create a first opening into a first portion of the axial hole to expose an end portion of the rod to be inserted in the axial hole to be welded to the body.

The invention may be further understood by the specification, drawings, and claims set forth herein.

DETAILED DESCRIPTION OF THE INVENTION

Figure 1:
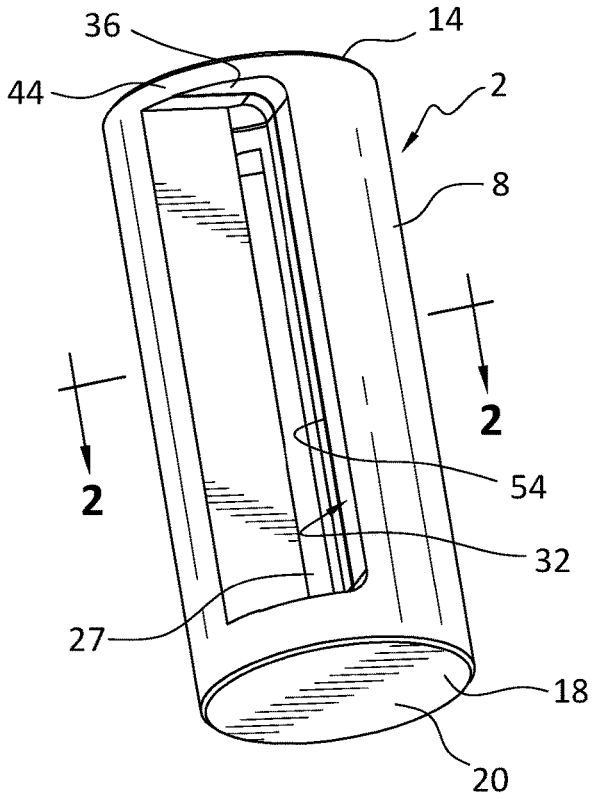
FIG. 1 is a perspective view of an anchor embodying the present invention.
Figure 2:
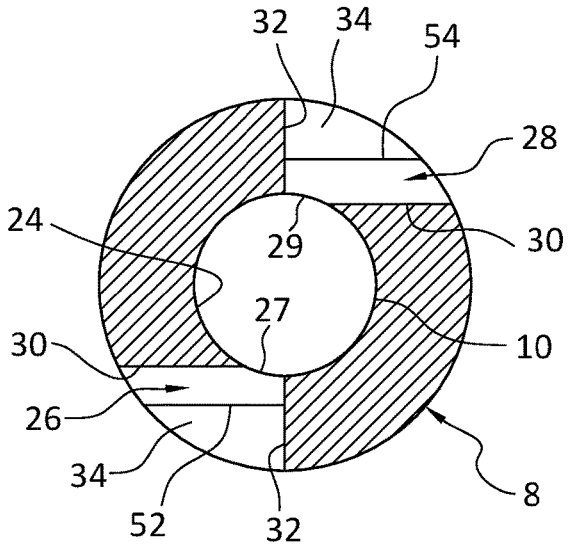
FIG. 2 is a cross-sectional view along line 2-2 in FIG. 1.
Figure 3:
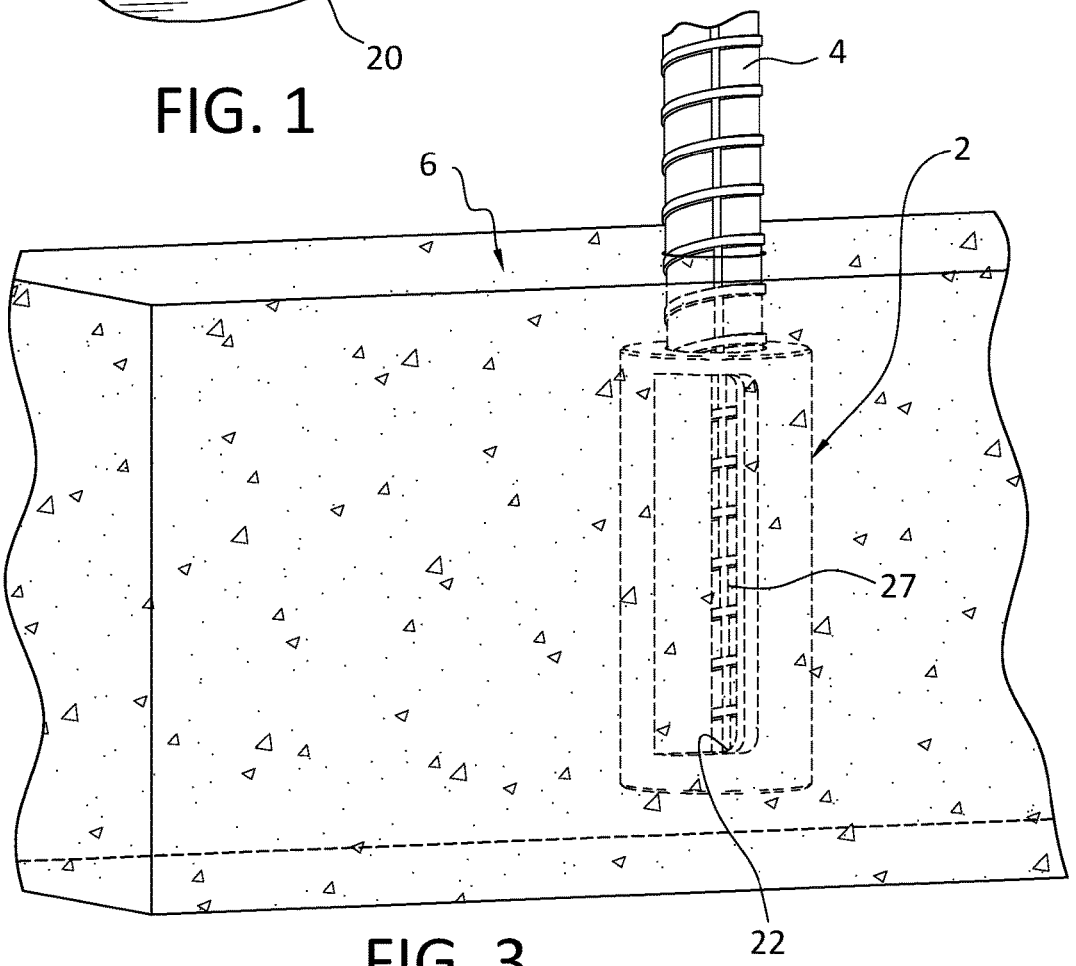
FIG. 3 is a perspective side view of FIG. 1 attached to a rebar and embedded in concrete.

Referring to FIGS. 1-3, an anchor 2 embodying the present invention is disclosed. The anchor 2 may be attached to a rod, such as a rebar 4, to form an anchor assembly for being embedded in a concrete structure 6. The anchor 2 may include a cylindrical body 8 and advantageously provides a fixture or welding jig for proper welding of the rebar 4 to anchor 2. The anchor 2 is preferably made of metal, such as steel, etc.

Although a rebar is shown in the drawings, it should be understood that other types of rods may be used, such as a threaded rod, smooth rod, hexagonal rod, etc.

Figure 4:
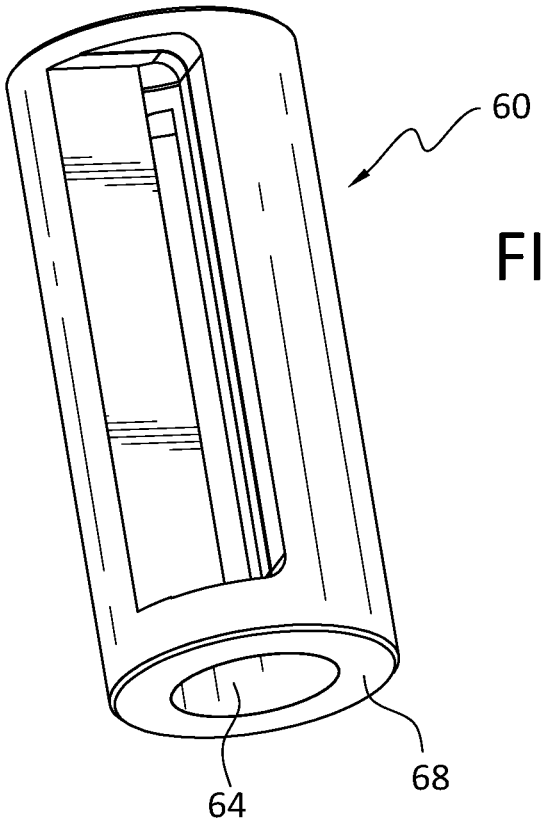
FIG. 4 is a perspective view of another anchor embodying the present invention.

The anchor 2 preferably has a cylindrical body 8 with an axial hole 10 extending from a first end 14 into an intermediate portion 22 of the body 8 or may extend to a second end 18 (see FIG. 4). Hole 10 is for receiving rebar 4. A bottom 20 on second end 18 may be solid where the hole 10 stops short of the second end 18.

The hole 10 has a cylindrical wall 24 with a first longitudinal cutout 26 and a second longitudinal cutout 28, which may be two opposite V-shaped cutouts 26 and 28 (see FIG. 2) that provide respective openings into hole 10. Each of the cutouts 26 and 28 has wall surfaces 30 and 32, respectively.

Wall surfaces 30 may be parallel and the wall surfaces 32 coplanar. The wall surface 30 is preferably perpendicular to the wall surface 32. The openings in cutouts 26 and 28 are longitudinal and expose a correspondingly longitudinal surface of the rebar 4 for welding rebar 4 to the adjacent wall surfaces 30 and 32 of the respective cutouts 26 and 28. The cutouts 26 and 28 preferably start below the top end 14 of the anchor 2 to provide a top or first collar portion 44 for structural integrity of the body 8 (see FIG. 1).

During the welding process, the collar portion 44 advantageously keeps the size of the axial hole 10 from expanding due to the heat generated by the welding process. The cutouts 26 and 28 preferably end before the bottom of the axial hole 10 to ensure that even if the end of the rebar 4 were not cut square, a portion of the rebar 4 presented at the openings in cutouts 26 and 28 are as long as the length of the openings in cutouts 26 and 28. Axial hole 10 is preferably longer in length than the length of either of the cutouts 26 and 28.

Referring to FIGS. 1 and 2, the wall surfaces 30 and 32 are provided with guides 52 and 54, respectively, to inform the welder of the required throat or thickness of the weld. The guides 52 and 54 may be respective lines scored into surfaces 30 and 32. Guides 52 and 54 may extend onto surfaces 34 and 36. The welding of the rebar 4 to the anchor 2 using the guides 52 and 54 is further discussed in application Ser. No. 16/895,632, filed Jun. 8, 2020, herein incorporated by reference.

In brief, it may be readily understood that the cutouts 26 and 28 function as openings in which welds can be made to secure anchor 2 to rebar 4. The rebar 4 is inserted into the hole 10 and welded to the anchor 2, using the windows or openings 27 and 29 provided by the cutouts 26 and 28 to the opening 10 to attach welding beads to the exposed surfaces of the rebar through the windows and the adjacent wall surfaces 30 and 32 of the respective cutouts 26 and 28. Although not shown in FIG. 3, the rebar 4 is understood to be welded to the anchor 2 through the cutouts 26 and 28. The rebar 4 extending outside the concrete structure 6 may be connected to another rebar or threaded rod with a coupler as shown in application Ser. No. 16/895,632, filed Jun. 8, 2020, herein incorporated by reference.

Figure 5:
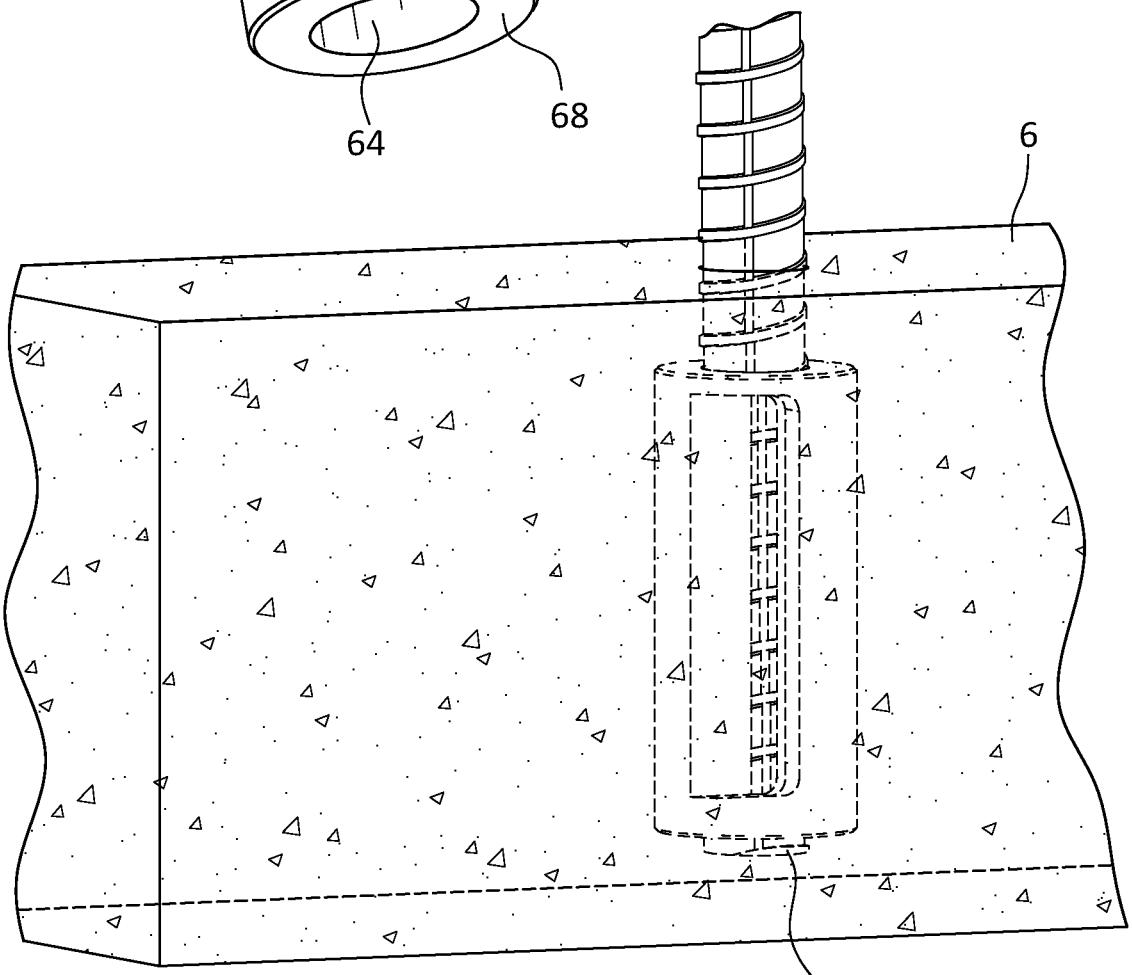
FIG. 5 is a perspective side view of FIG. 4 attached to a rebar and embedded in concrete.

Referring to FIGS. 4 and 5, a further anchor 60 is disclosed. FIG. 4 is a perspective view of the anchor 60 embodying the present invention. The opening 10 extends to opening 64 past the bottom or second collar 68. FIG. 5 is a perspective view of FIG. 4 embedded in concrete structure 6, showing the rebar 4 extending past the bottom or second collar 68 through the opening 64. Although not shown in FIG. 5, the rebar 4 is understood to be welded to the anchor 2 through the cutouts 26 and 28 as already described above.

Figure 6:
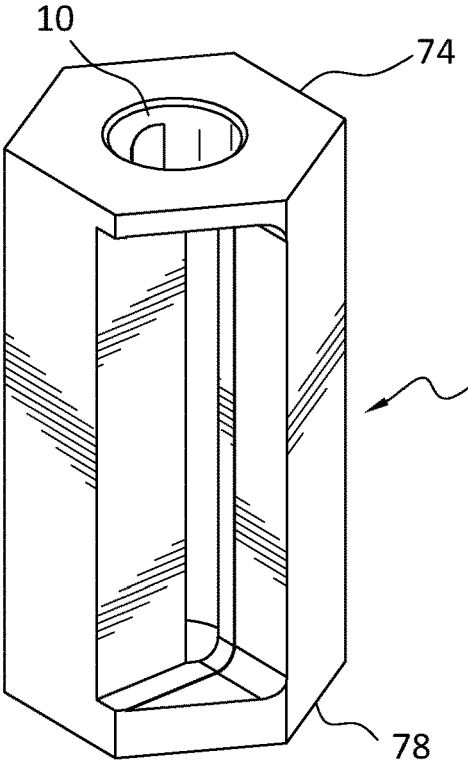
FIG. 6 is a perspective view of another anchor embodying the present invention.
Figure 7:
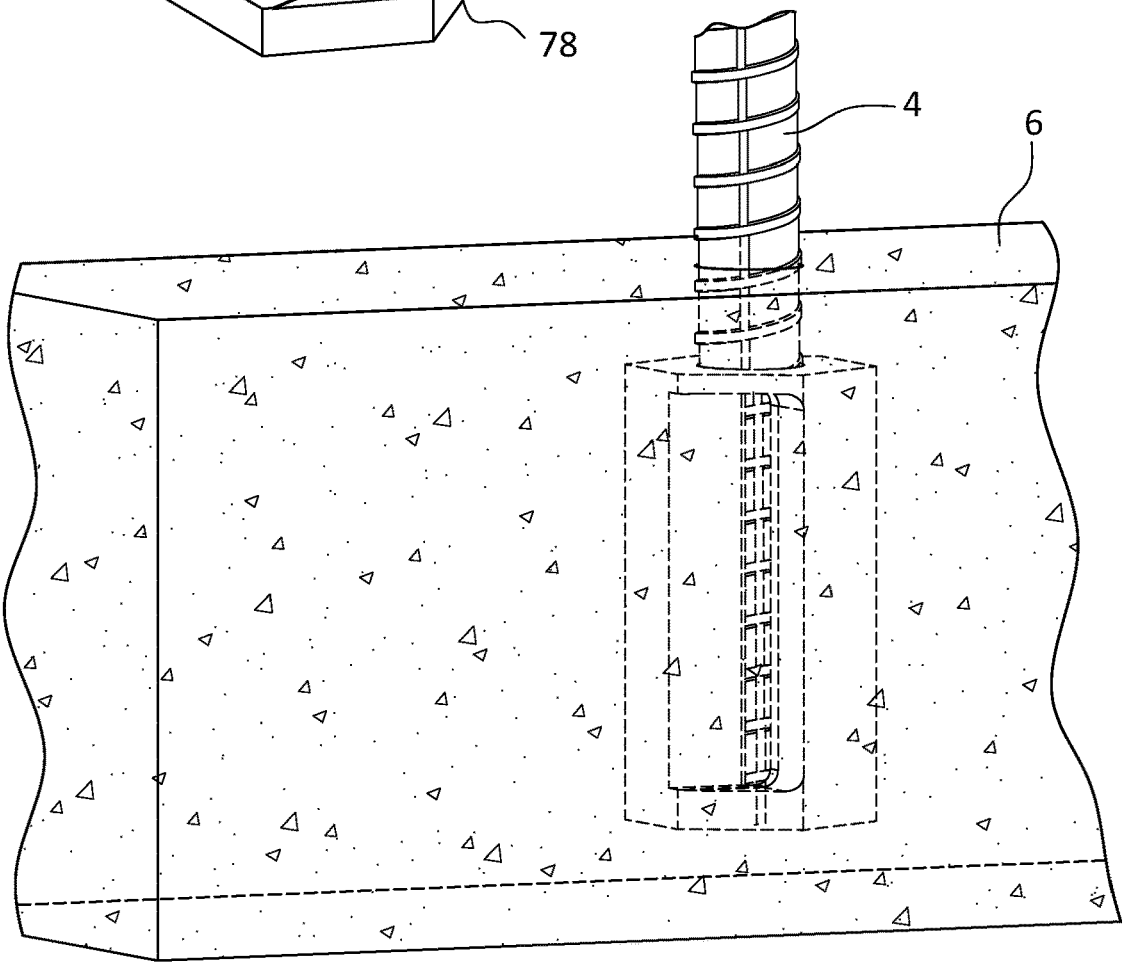
FIG. 7 is a perspective side view of FIG. 6 attached to a rebar and embedded in concrete.

Referring to FIGS. 6 and 7, a further anchor 70 is disclosed. FIG. 6 is a perspective view of the anchor 70 showing a hexagonal exterior side 78. FIG. 7 is a perspective view of FIG. 6 attached to a rebar and embedded in concrete structure 6.

Figure 8:
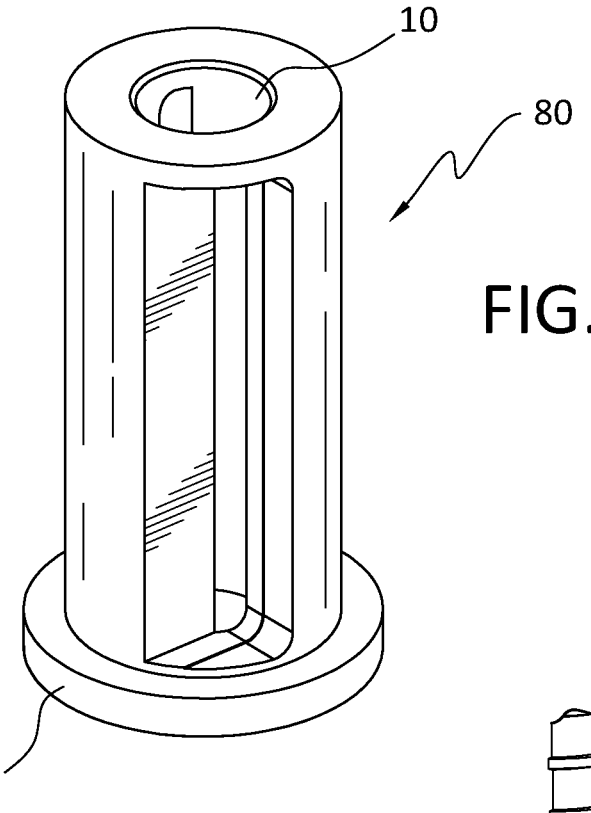
FIG. 8 is a perspective view of another anchor 80 embodying the present invention.
Figure 9:
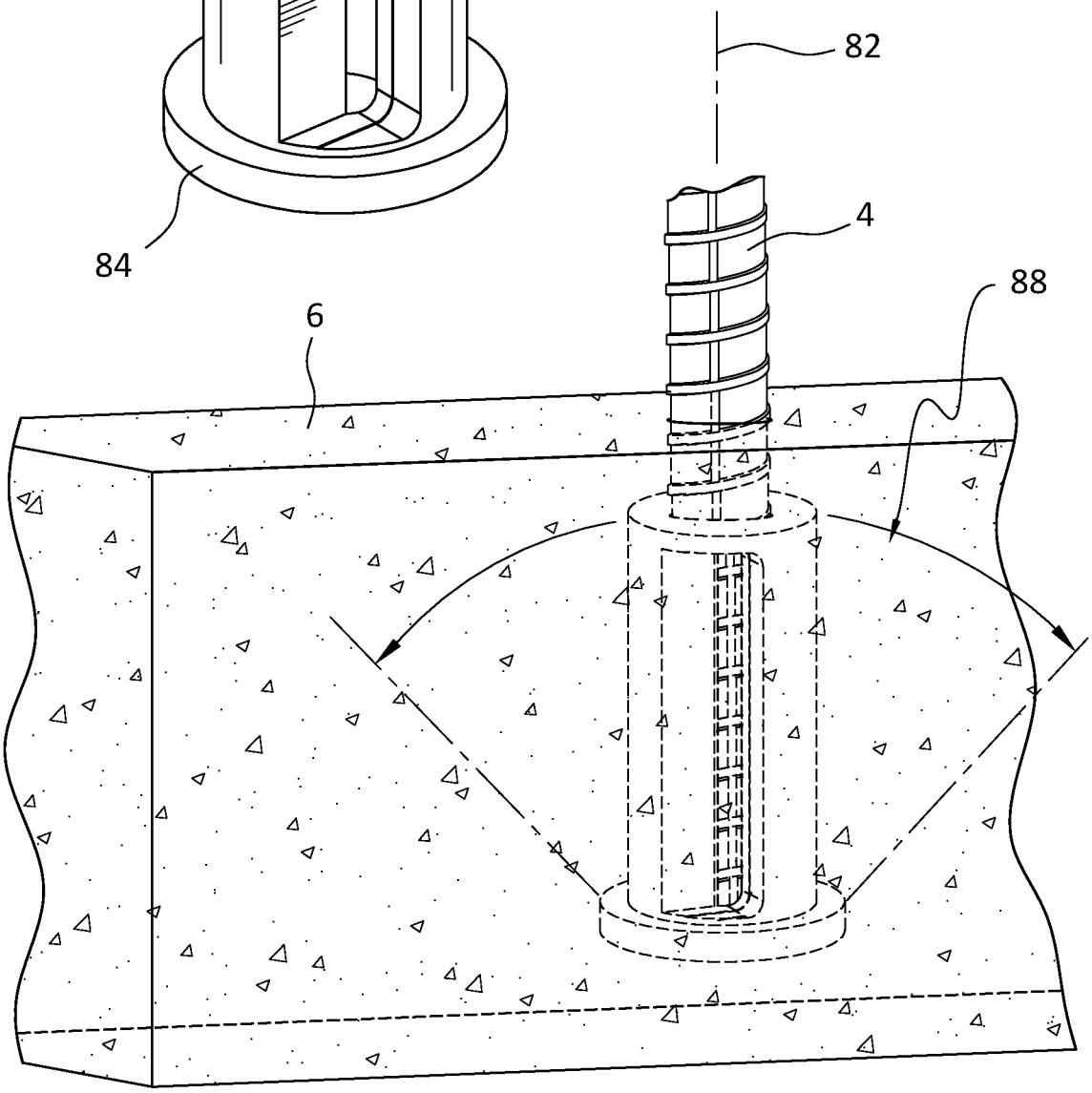
FIG. 9 is a perspective view of anchor 80 of FIG. 8, attached to a rebar and embedded in concrete and showing a shear cone when subjected to a load.

Referring to FIGS. 8 and 9, a further anchor 80 is disclosed. The anchor 80 includes a lower flange 84 which has a larger diameter than the diameter of the upper portion of anchor 80. The lower position of the flange 84 advantageously allows the anchor to create a larger shear cone 88 in response to a load applied upwardly along the rebar 4. A longitudinal axis 82 extends lengthwise in a central portion of anchor 80.

The shear cone 88 is shown in FIG. 9. Shear cone 88 may be referred to as a breakout cone 88. See the "breakout cone[s]" shown in the Earthbound Corporation link https://www.chubbysmack.com/converter.aspx, Copyright 2020 Earthbound Corp. which is incorporated herein by reference.

Figure 10:
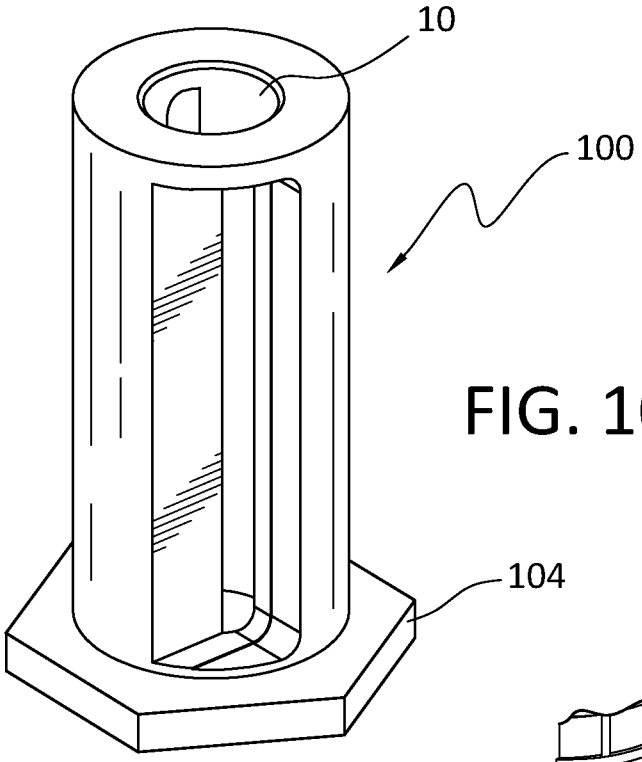
FIG. 10 is a perspective view of another anchor embodying the present invention.
Figure 11:
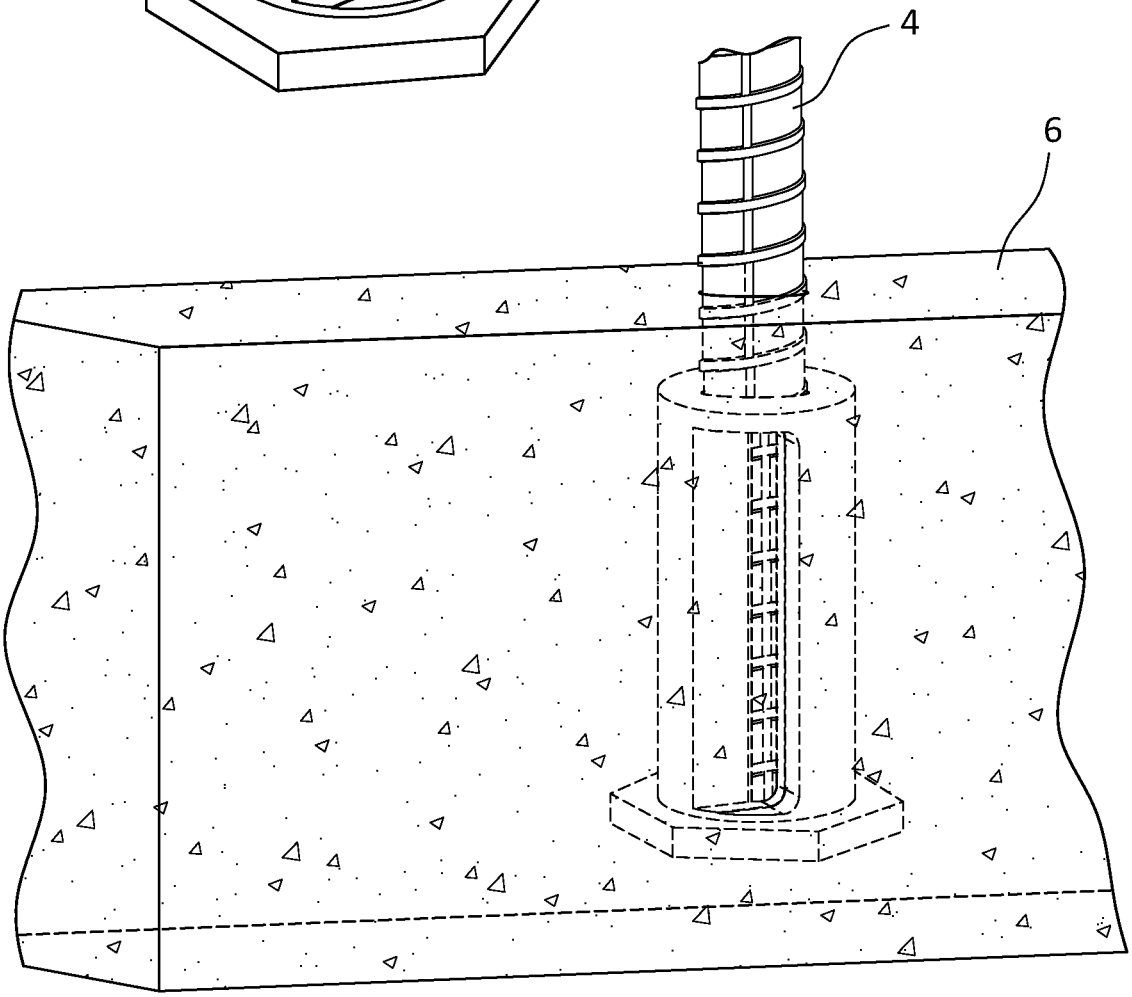
FIG. 11 is a perspective view of FIG. 10, attached to a rebar and embedded in concrete.
Figure 12:
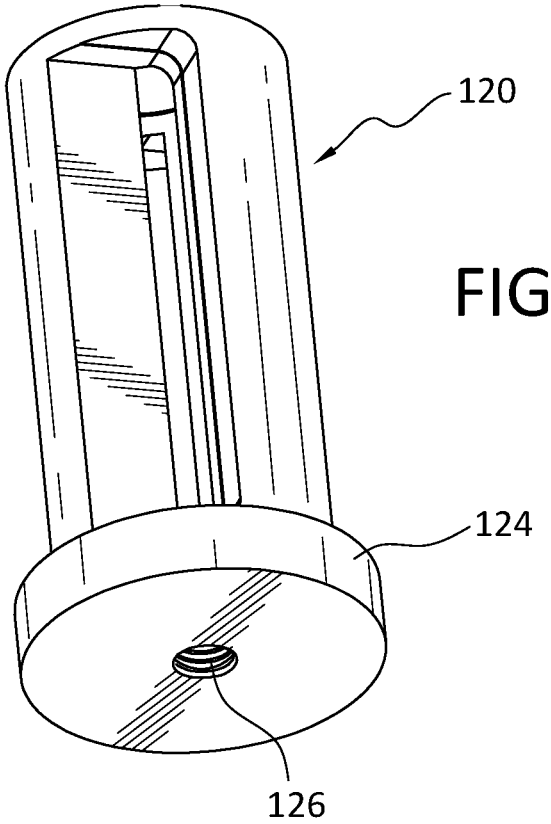
FIG. 12 is a perspective view of another anchor embodying the present invention.

Referring to FIGS. 10 and 11, another anchor 100 is disclosed that includes a lower flange 104 which may have a hexagonal outer perimeter. The flange 104 serves the same purpose as the flange 84 of the anchor 80. FIG. 11 is a perspective view of FIG. 10 embedded in concrete structure 6. Although not shown in FIG. 11, the rebar 4 is understood to be welded to the anchor 2 through the cutouts 26 and 28 as already described above.

Referring to FIGS. 12-16, a further anchor 120 is disclosed with a lower flange 124 which may have a circular outer diameter. The flange 124 serves the same purpose as the flange 84 of the anchor 80. Anchor 120 may have a substantially central hole 126 to which a support 128 formed from sheet metal may be attached. The anchor 120 is shown attached to the support 128 with a nut 132 and a bolt or stud 134 threaded to the hole 126. The anchor 120 is welded to the rebar 4 and embedded in concrete structure 6. Although not shown in FIG. 13, the rebar 4 is understood to be welded to the anchor 120 through the cutouts 26 and 28 as already described above.

Figure 13:
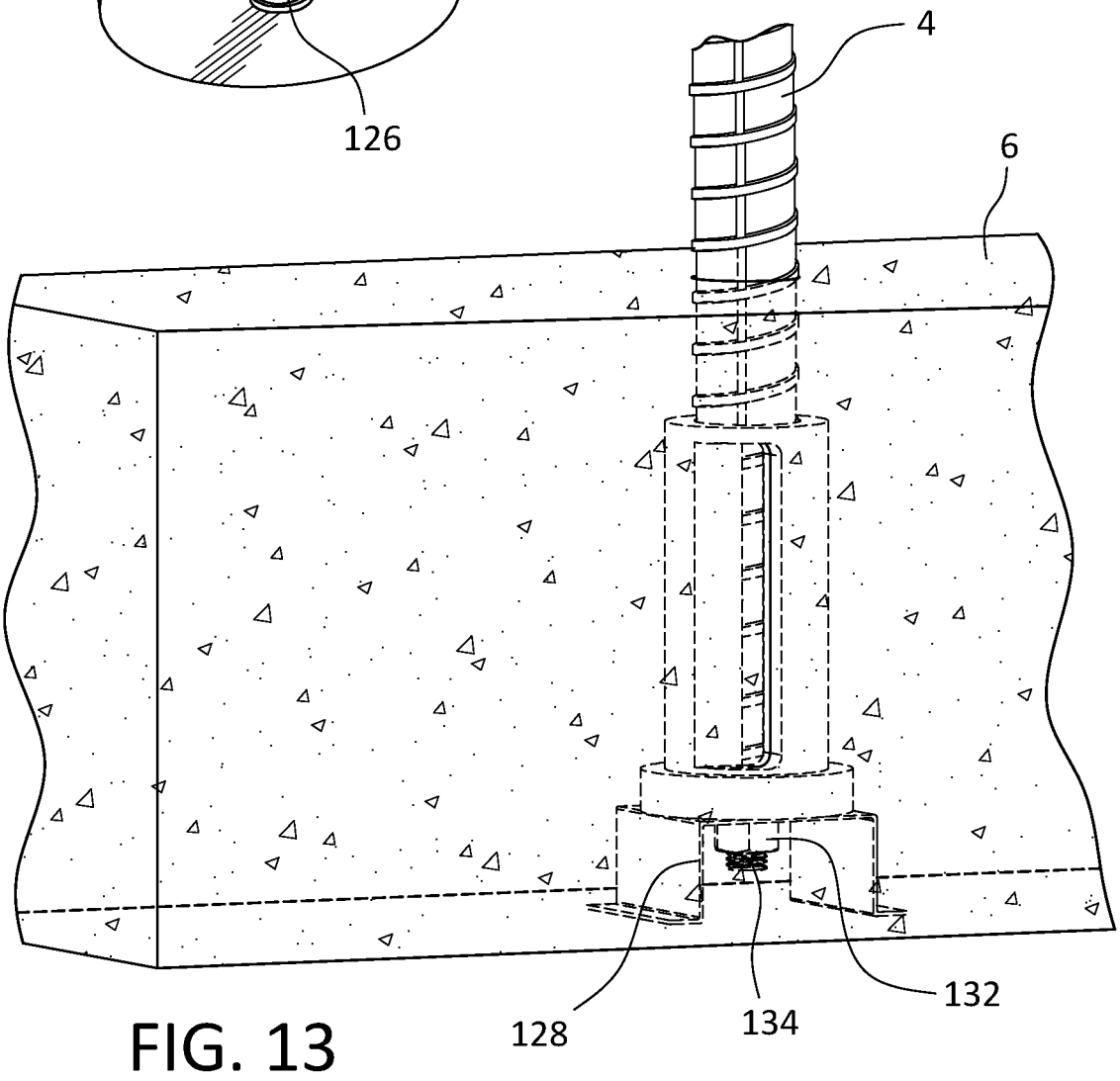
FIG. 13 is a perspective view of the anchor of FIG. 12 with a support attached to a lower portion of the anchor, and a rebar attached to the anchor and embedded in concrete.
Figure 14:
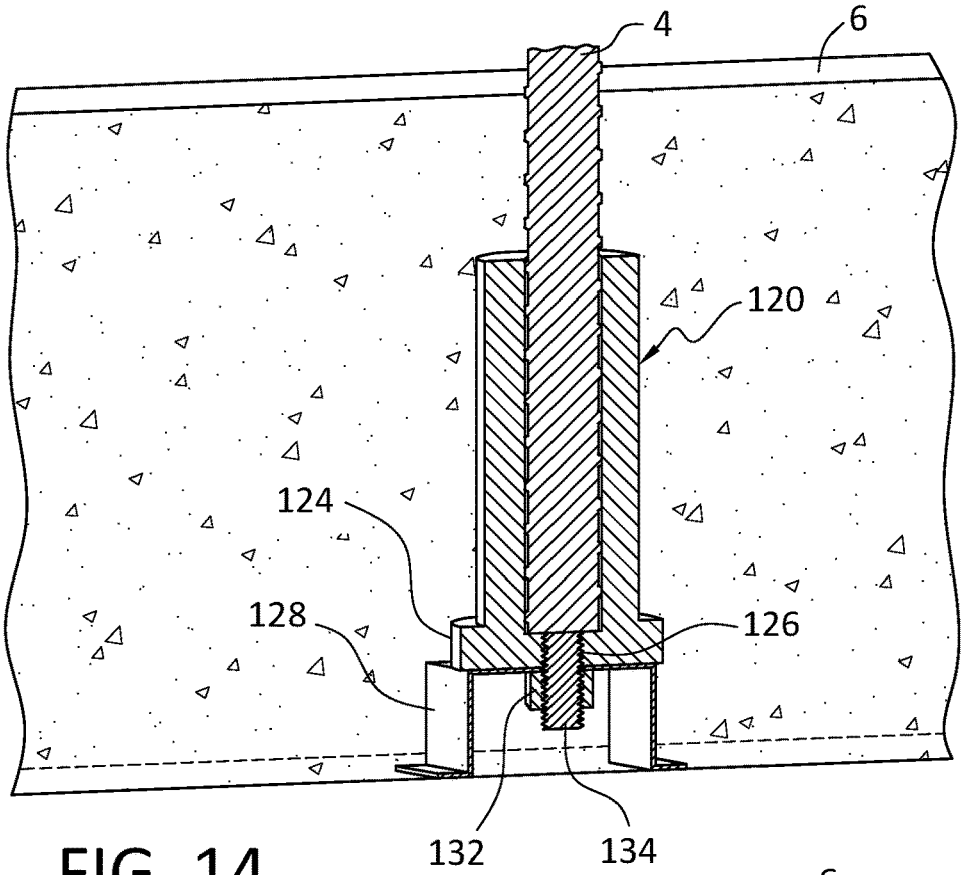
FIG. 14 is a cross-sectional view of FIG. 13.

Referring to FIG. 14, which is a cross-sectional view of FIG. 13, threaded central hole 126 extends through flange 124 and stud 134 may engage rebar 4, as shown. Nut 132 and stud 134 attach the support 128 to anchor 120.

Figure 15:
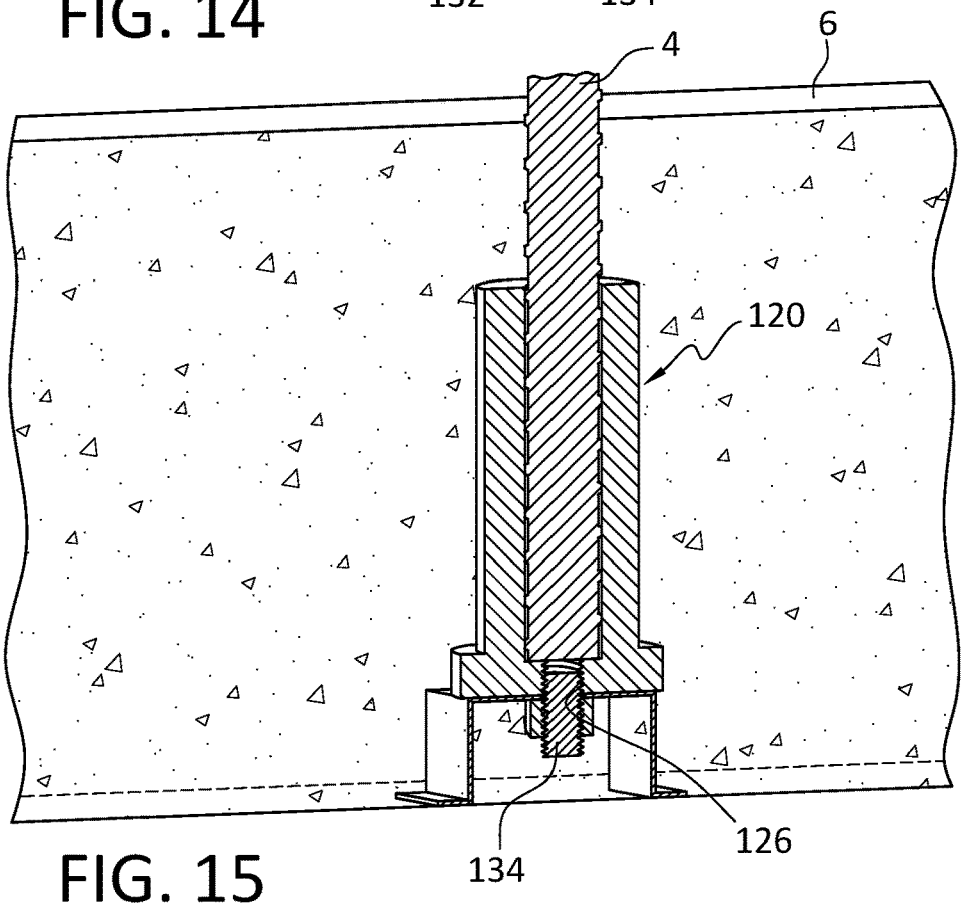
FIG. 15 is further cross-sectional view of FIG. 13.

Referring to FIG. 15, which is a cross-sectional view of FIG. 13, the stud 134 is shown partially threaded into a threaded hole 126, and fastener 132 securing the support 128 to anchor 120. Stud 134 does not engage rebar 4, as shown.

Figure 16:
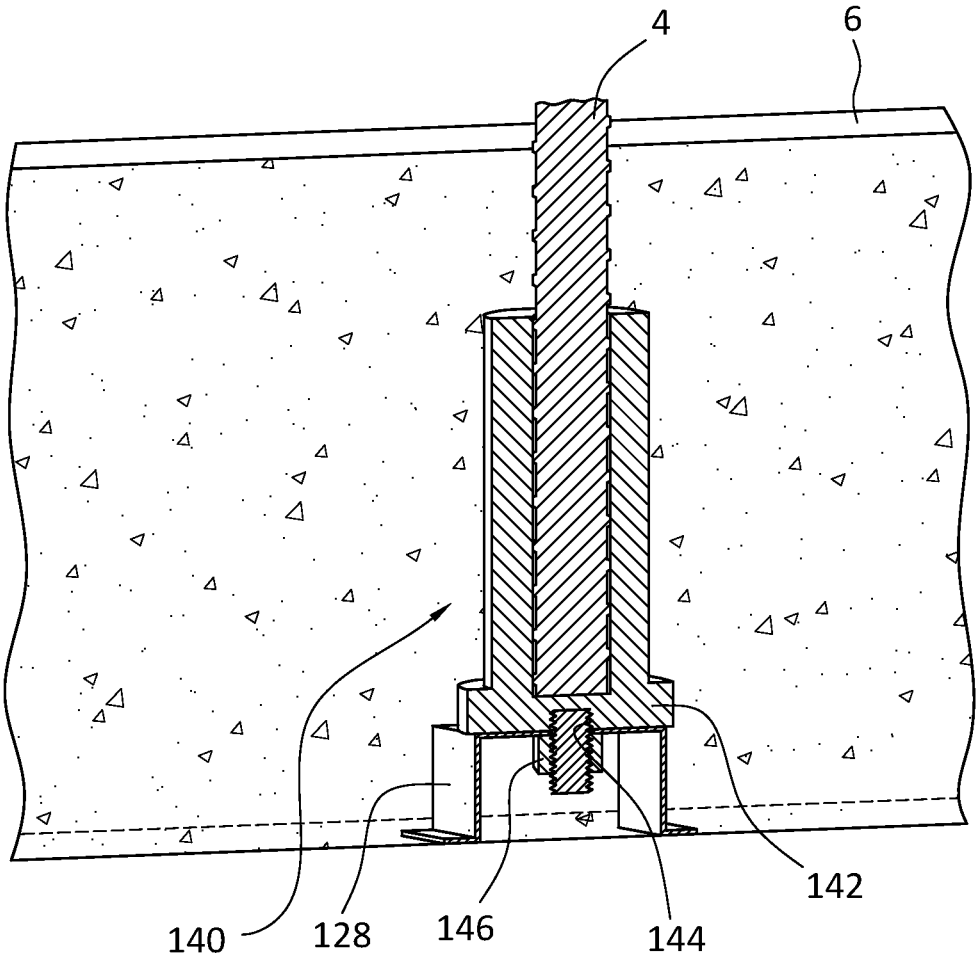
FIG. 16 is a cross-sectional view of a further embodiment of an anchor similar to the anchor of FIG. 15.

Referring to FIG. 16, a further embodiment of an anchor 140 is shown in cross-section. The anchor 140 is similar to anchor 120, which is shown in cross-section in FIG. 15. The anchor 140 has a closed bottom end in flange 142, and in which flange 142 has an external blind hole 144. Hole 144 is open to the exterior of anchor 140. A threaded rod or stud in hole 144 may be used to secure the support 128 to anchor 140 with a fastener 146, such as a nut to the support 128.

Figure 17:
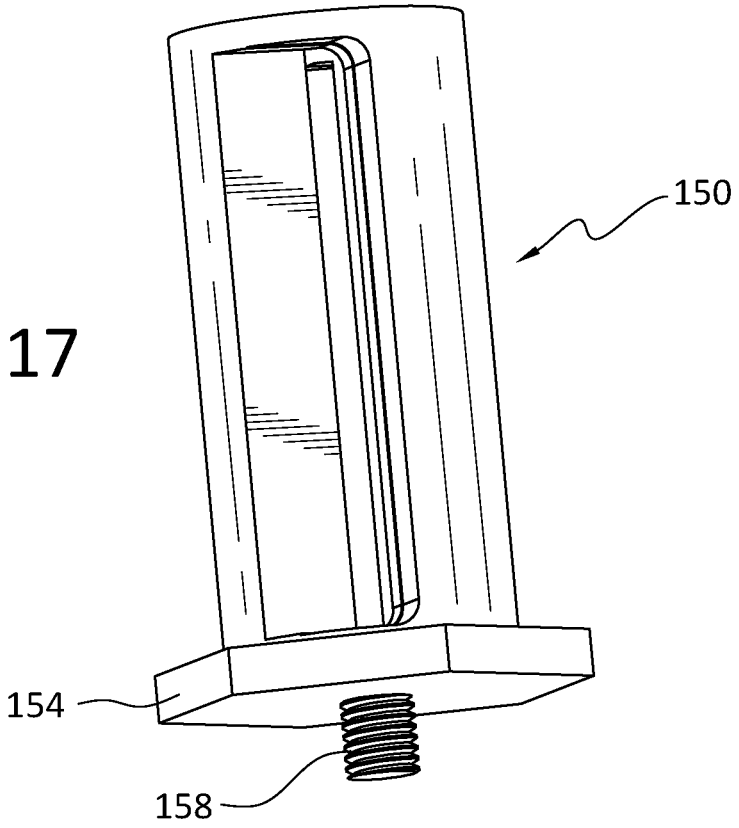
FIG. 17 is a perspective view of another embodiment of an anchor.
Figure 18:
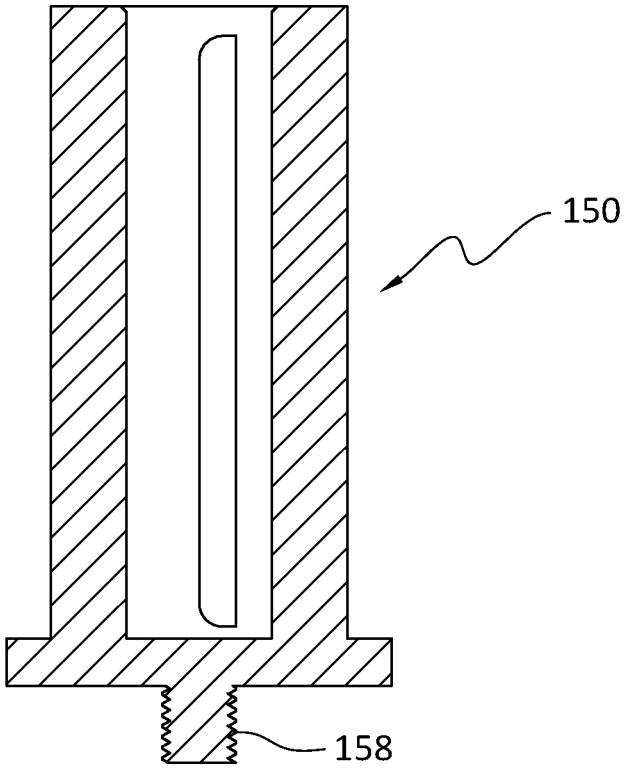
FIG. 18 is a cross-sectional view of FIG. 17.

Referring to FIGS. 17 and 18, another embodiment of an anchor 150 is disclosed. Anchor 150 is similar to anchor 100 of FIGS. 10 and 11. Anchor 150 may include a flange 154, which may have a hexagonal outer perimeter. A threaded rod 158 may extend outwardly from a bottom of anchor 150. The threaded rod 158 is integral with and forms part of the anchor 150. The threaded 158 provides the same function as the stud 134 in attaching the support 128 with the fastener 134 to the anchor 150. FIG. 18 is a cross-sectional view of FIG. 17.

Figure 19:
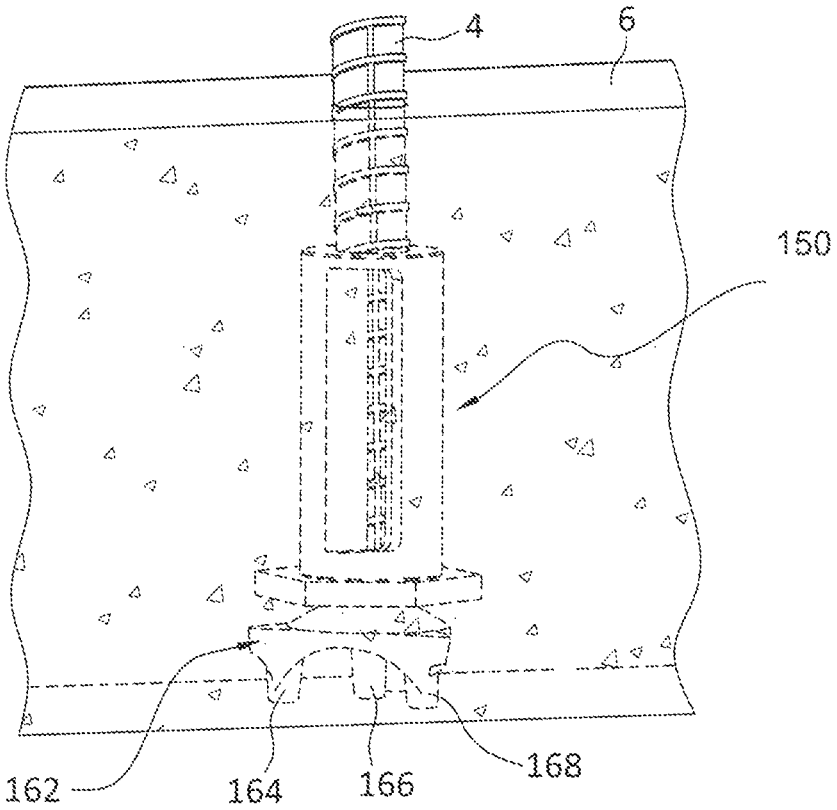
FIG. 19 is a perspective view of the anchor of FIG. 17 attached to a rebar and a support attached to a lower portion of the anchor and embedded in concrete.
Figure 20:
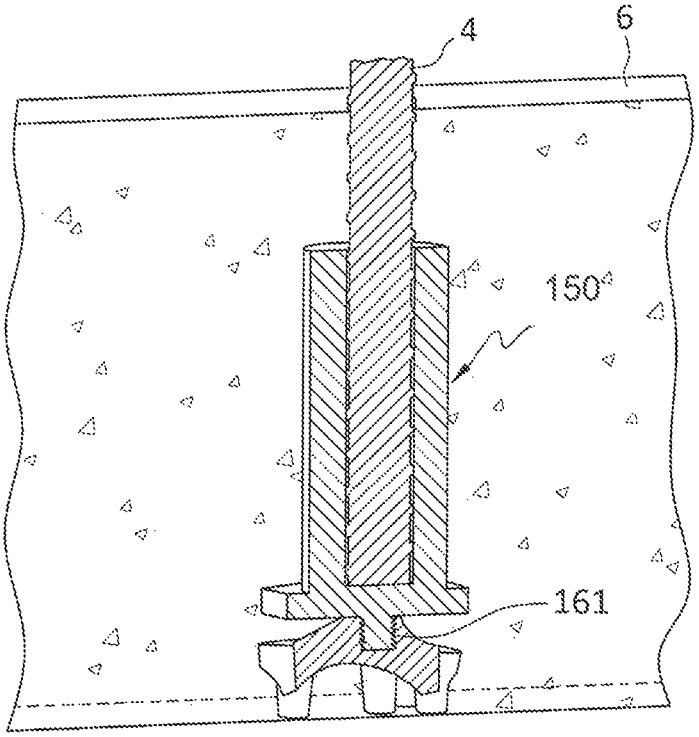
FIG. 20 is a cross-sectional view of FIG. 19.

Referring to FIGS. 19 and 20, the anchor 150 is shown attached to the rebar 4 and supported by support 162 and embedded in concrete structure 6. The support 162 has several legs 164, 166, and 168 to elevate the anchor 150. The support 162 includes a central threaded hole 161 into which the threaded rod 158 is threaded. The support 162 is similar to those disclosed in U.S. Pat. Nos. 8,943,777, 9,222,251, 10,577,816, hereby incorporated herein by reference. FIG. 20 is a cross-sectional view of anchor 150.

Figure 21:
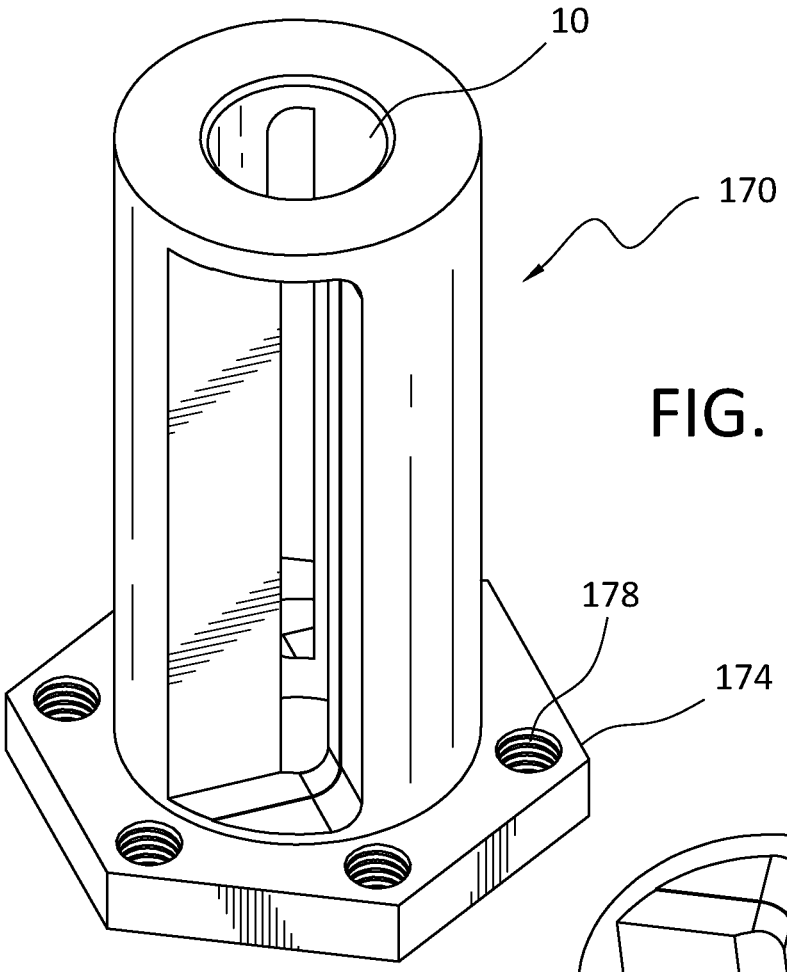
FIG. 21 is a perspective view of another embodiment of an anchor.
Figure 22:
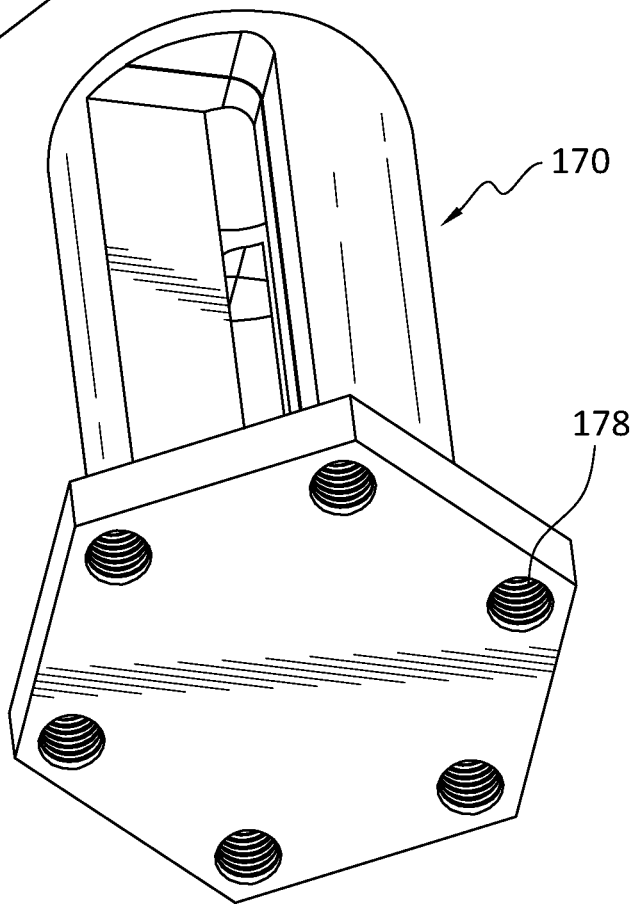
FIG. 22 is a lower perspective view of FIG. 21.

Referring to FIGS. 21 and 22, another embodiment of an anchor 170 having a flange 174 is shown. Flange 174 may have a hexagonal perimeter and several threaded holes 178 may be provided therein. The holes 178 may be used to attach threaded rods and then bent into an L-shape, similar to that shown in FIG. 34, to advantageously provide additional anchorage to the anchor 170. The anchor 170 is used in the same way as shown with the other embodiments, with the rebar 4 welded to the anchor 170 and embedded in the concrete structure 6.

Figure 23:
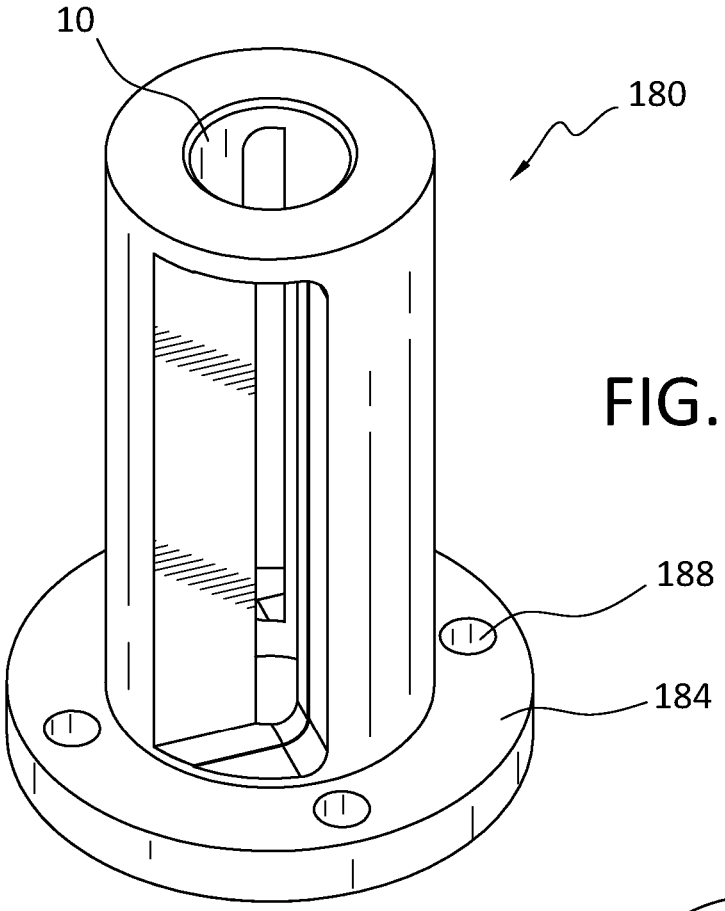
FIG. 23 is a perspective view of another embodiment of an anchor.
Figure 24:
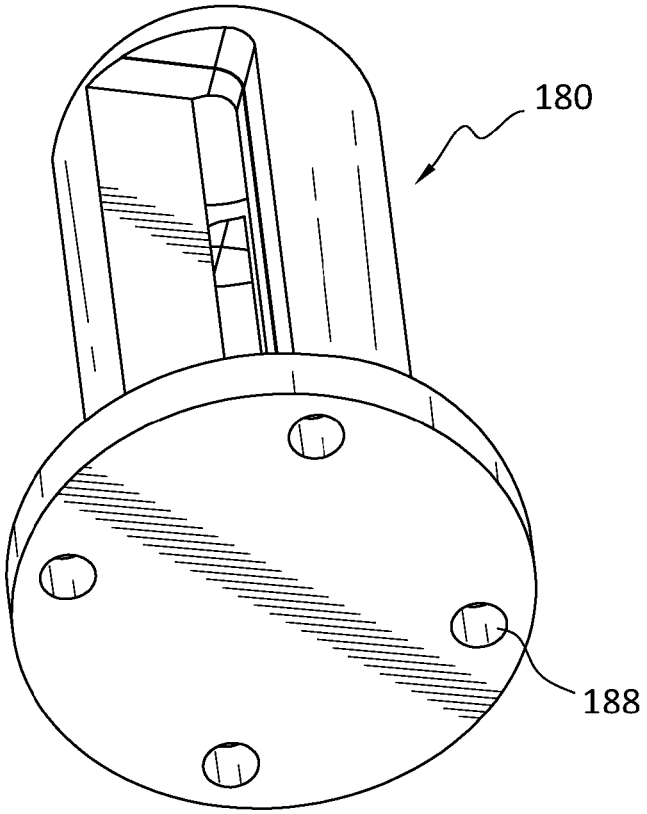
FIG. 24 is a lower perspective view of FIG. 23.

Referring to FIGS. 23 and 24, another embodiment of an anchor 180 having a flange 184 is disclosed. Flange 184 may have a circular perimeter and several unthreaded holes 188 may be provided therein. The holes 188 may be used to attach threaded rods or rebars 4 by welding or other standard means and then bent into an L-shape, similar to that shown in FIG. 34, to advantageously provide additional anchorage to the anchor 180. The anchor 180 is used in the same way as shown with the other embodiments, with the rebar 4 welded to the anchor 180 and embedded in the concrete structure 6.

Figure 25:
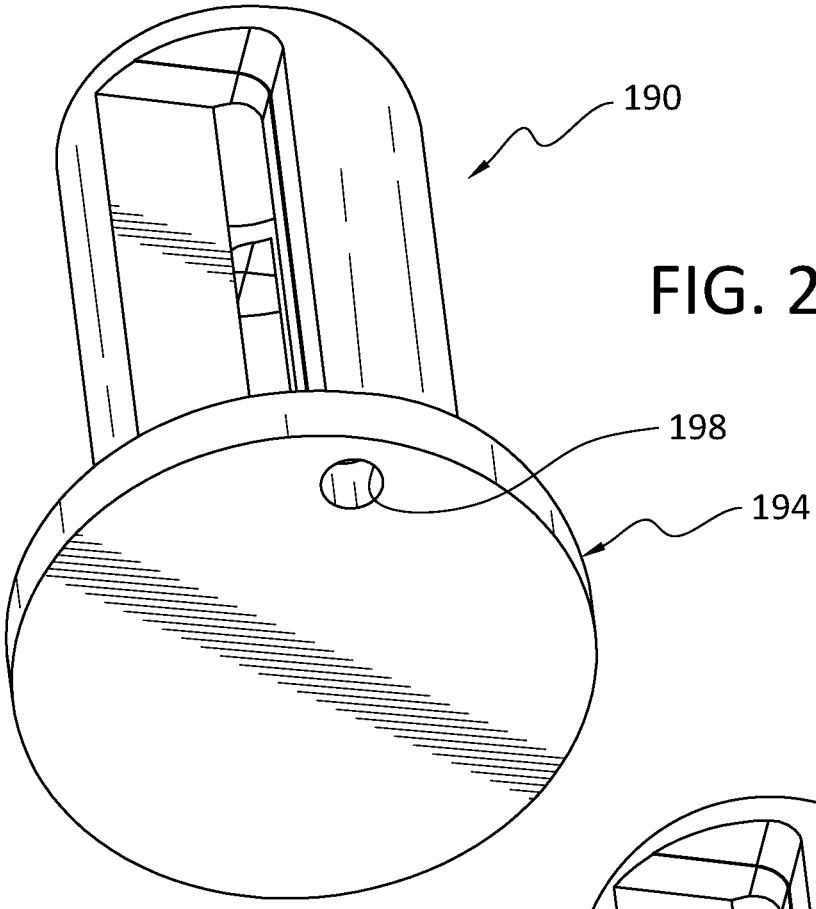
FIG. 25 is a perspective view of another embodiment of an anchor.

Referring to FIG. 25, another embodiment of an anchor 190 having a flange 194 is disclosed. Flange 194 may have a circular perimeter and an unthreaded hole 198 may be provided therein. The hole 198 may be used to attach threaded rods or rebars 4 by welding or other standard means and then bent into an L-shape, similar to that shown in FIG. 34, to advantageously provide additional anchorage to the anchor 190. The anchor 190 is used in the same way as shown with the other embodiments, with the rebar 4 welded to the anchor 190 and embedded in the concrete structure 6.

Figure 26:
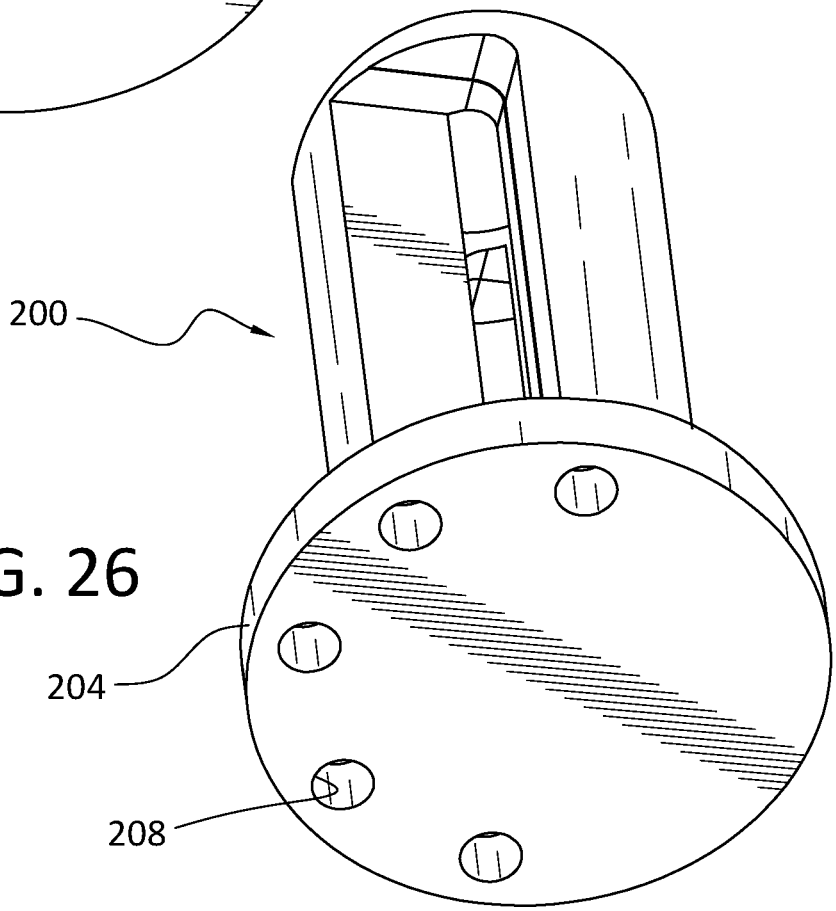
FIG. 26 is a perspective view of another embodiment of an anchor.

Referring to FIG. 26, another embodiment of an anchor 200 having a flange 204 is disclosed. Flange 204 may have a circular perimeter and several unthreaded holes 208 may be provided therein. Unthreaded holes 208 may be non-symmetrically provided in flange 204, as shown. The hole 208 may be used to attach threaded rods or rebars 4 by welding or other standard means and then bent into an L-shape, similar to that shown in FIG. 34, to advantageously provide additional anchorage to the anchor 200. The anchor 200 is used in the same way as shown with the other embodiments, with the rebar 4 welded to the anchor 190 and embedded in the concrete structure 6.

Figure 27:
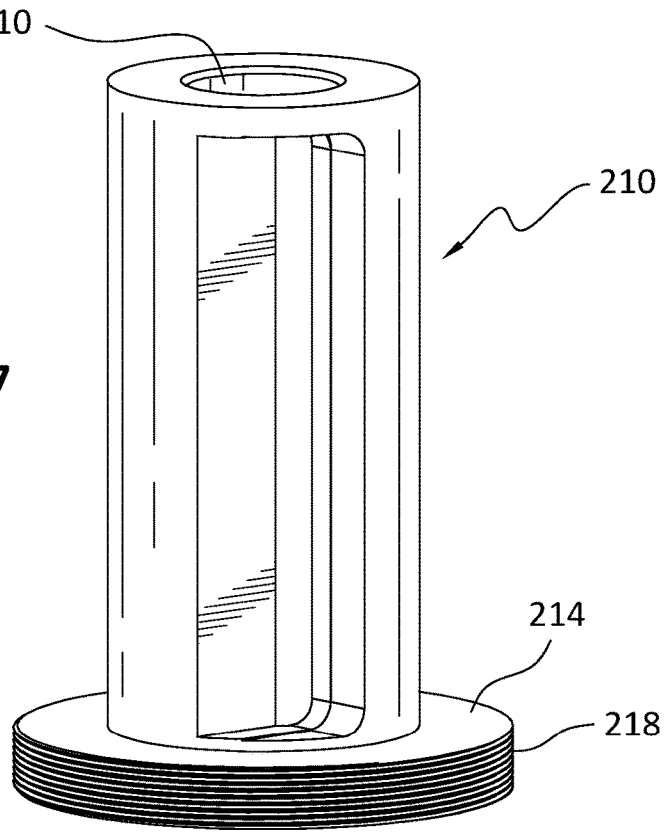
FIG. 27 is a perspective view of another embodiment of an anchor.
Figure 28:
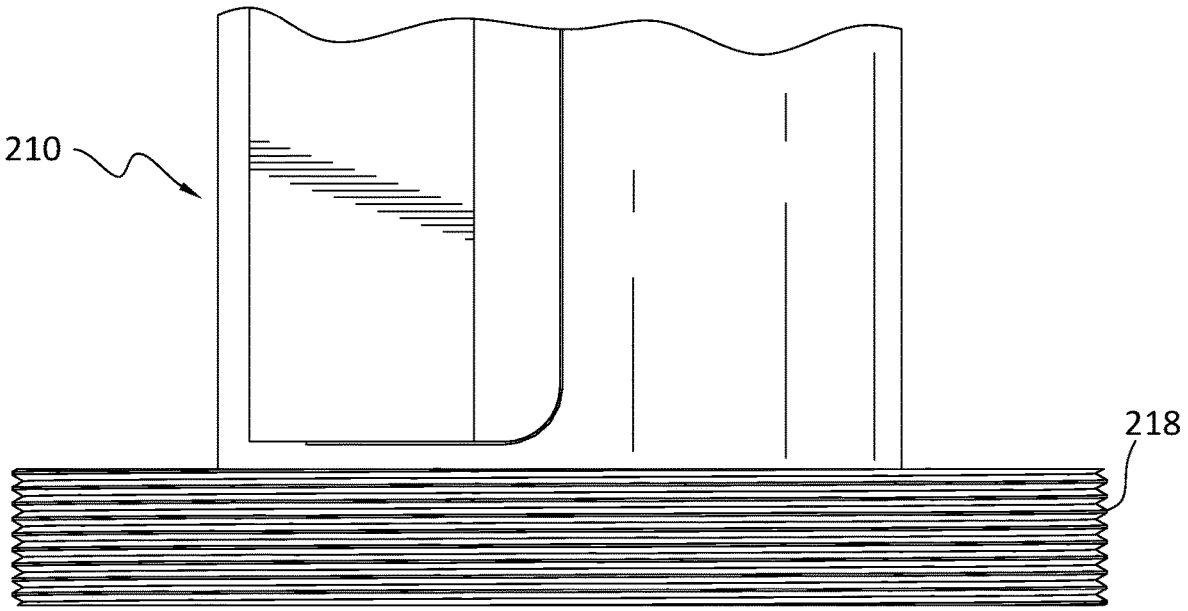
FIG. 28 is a side view of the flange of the anchor of FIG. 27.

Referring to FIGS. 27 and 28, another embodiment of an anchor 210 having a flange 214 is disclosed. Flange 214 may have a circular perimeter including a threaded perimeter surface 218. The thread on the surface 218 advantageously provides additional gripping surfaces against the concrete structure 6 when load is applied to the anchor 210. The anchor 210 is used in the same way as shown with the other embodiments, with the rebar 4 welded to the anchor 190 and embedded in the concrete structure 6.

Figure 29:
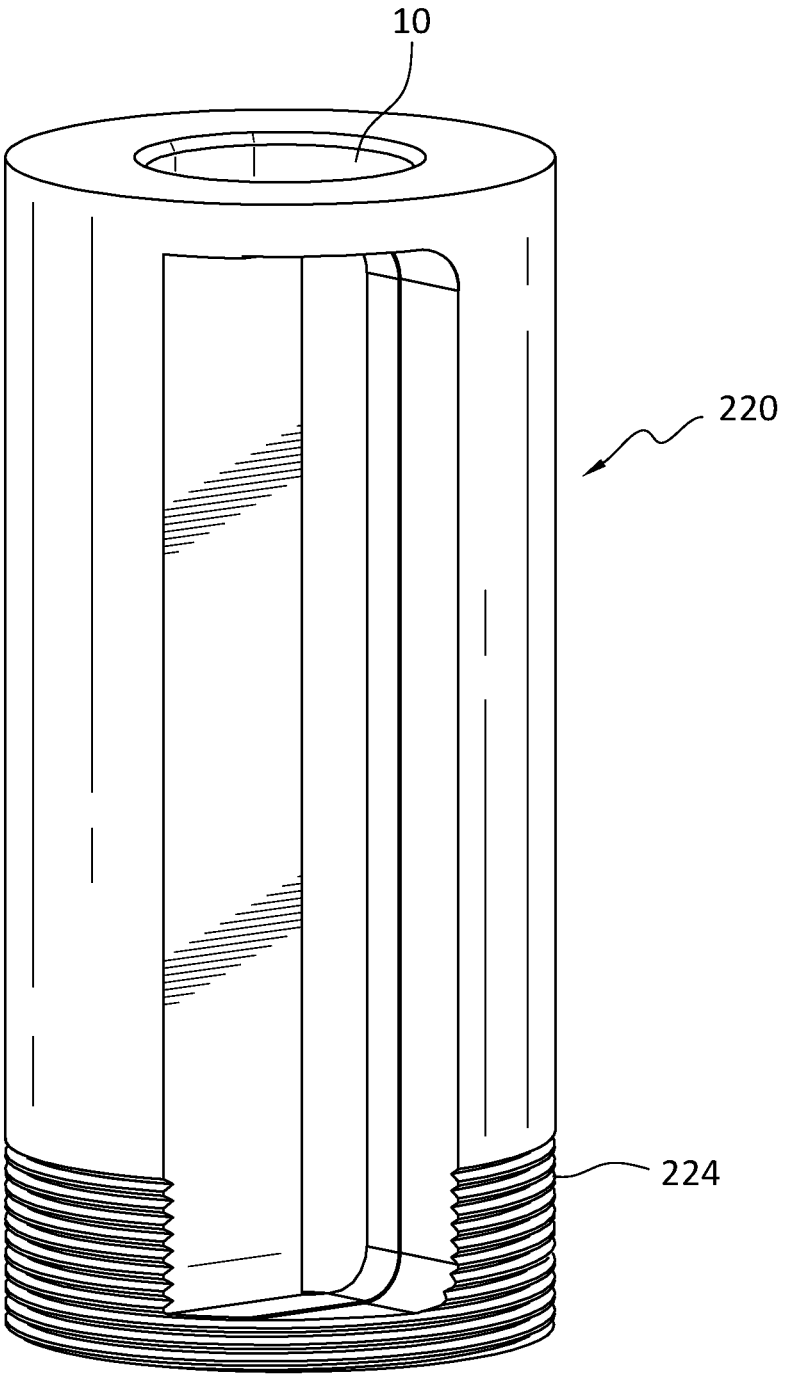
FIG. 29 is a perspective view of another embodiment of an anchor.

Referring to FIG. 29, another embodiment of an anchor 220 is disclosed. Anchor 220 preferably has a cylindrical body with an axial hole 10 extending from a first end into an intermediate portion of the body, similar to the anchor 2 shown in FIG. 1. The hole 10 may also extend through the second end of the anchor 220, similar to the anchor 60 shown in FIG. 4. The hole is for receiving rebar 4, in a manner similar to the embodiment of anchor 2 of FIGS. 1-3. As shown, the cylindrical perimeter may include a threaded portion 224. The threaded portion 224 advantageously provides additional gripping surfaces against the concrete structure 6 when load is applied to the anchor 220. The anchor 220 is used in the same way as shown with the other embodiments, with the rebar 4 welded to the anchor 220 and embedded in the concrete structure 6.

Figure 30:
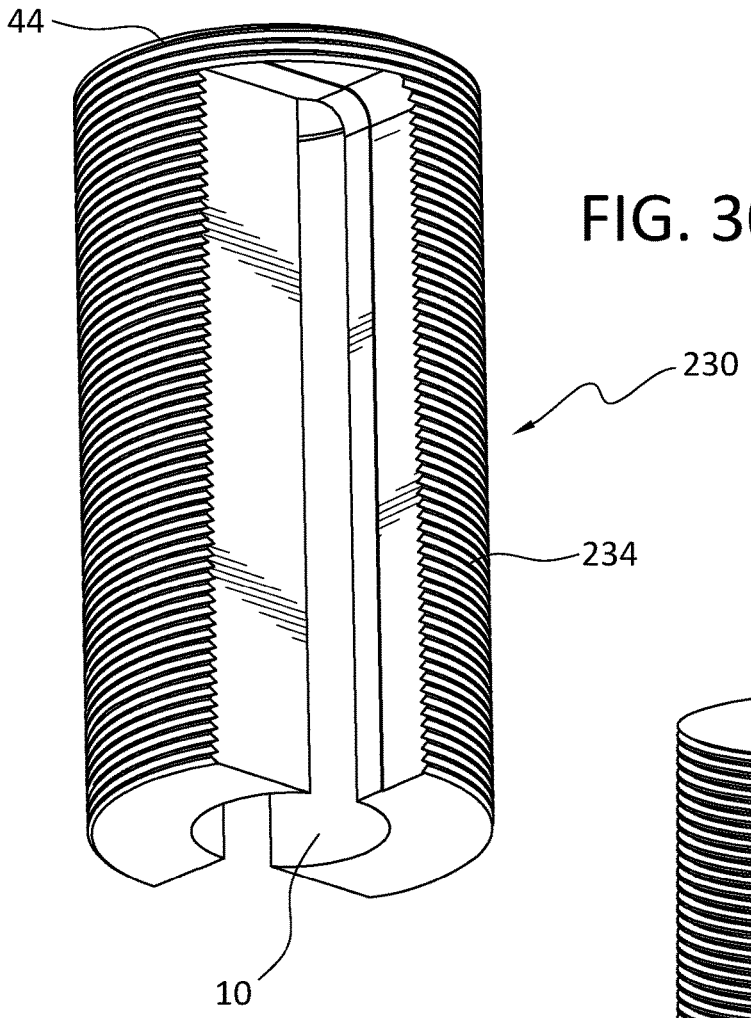
FIG. 30 is a perspective view of another embodiment of an anchor.

Referring to FIG. 30, another embodiment of an anchor 230 is disclosed. Anchor 230 preferably has a cylindrical body with an axial hole 10 extending through the body from a first end to a second end. The anchor 230 includes the collar 44 only at one end, which may be the top end or the bottom end. The hole 10 is for receiving and attaching by welding the rebar 4, in a manner similar to the embodiments of the anchor disclosed herein. As shown, substantially the entire length of the cylindrical perimeter 234 may be threaded to advantageously provide additional gripping surfaces against the concrete structure 6 when load is applied to the anchor 230. The anchor 230 is used in the same way as shown with the other embodiments, with the rebar 4 welded to the anchor 230 and embedded in the concrete structure 6.

The threads of the anchor 230 may also be applied to the cylindrical body of the anchor shown in FIGS. 8, 10, 12, 21, 27, 29 and 32. The anchor 230 may also be provided with a smooth outer surface or provided with a flange portion attached to the collar 44 as generally shown in FIGS. 8-27.

Figure 31:
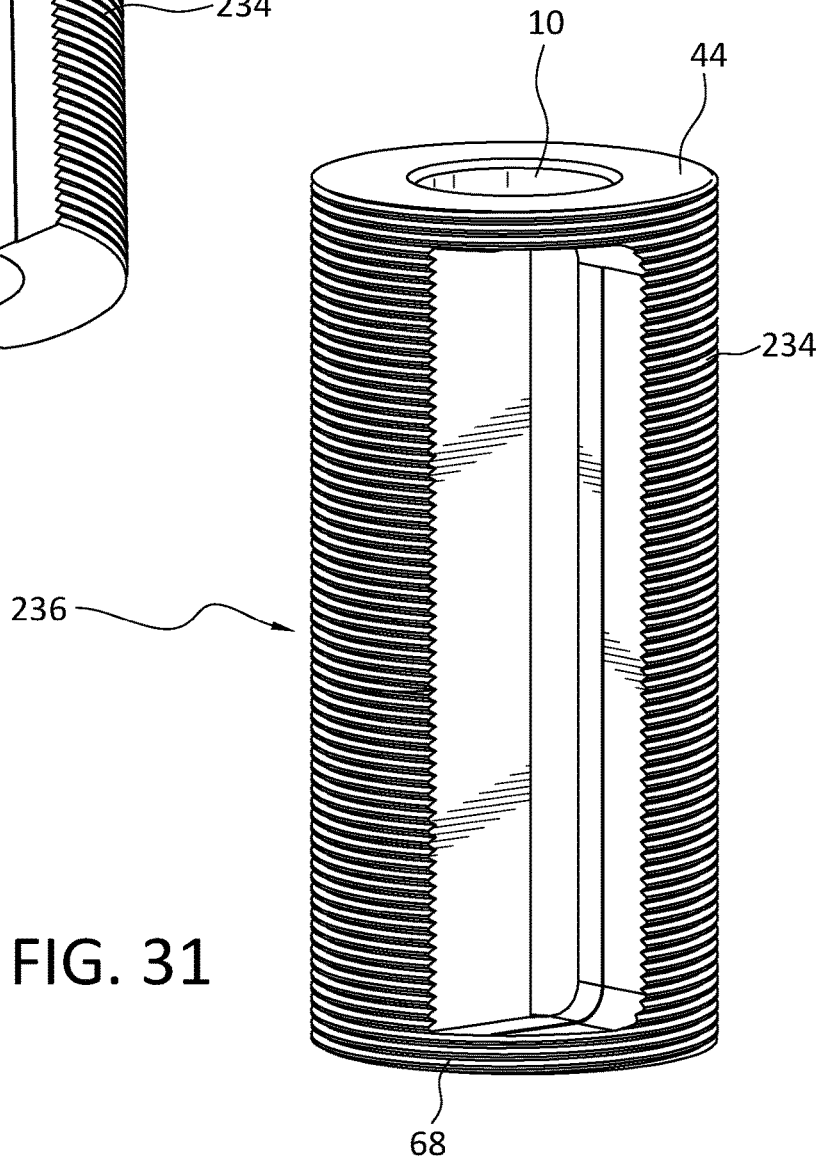
FIG. 31 is a perspective view of another embodiment of an anchor.

Referring to FIG. 31, another embodiment of an anchor 236 is disclosed. The anchor 236 is similar to the anchor 230, except that a bottom wall 68 is provided. The collar 44 and the bottom wall 68 advantageously provides rigidity to the anchor 236 during the welding of the rebar 4 to the anchor. The hole 10 may extend from the first end into an intermediate portion 22 of the body or may also extend through the bottom wall 68. The anchor 236 is used in the same way as shown with the other embodiments, with the rebar 4 welded to the anchor 236 and embedded in the concrete structure 6.

Figure 32:
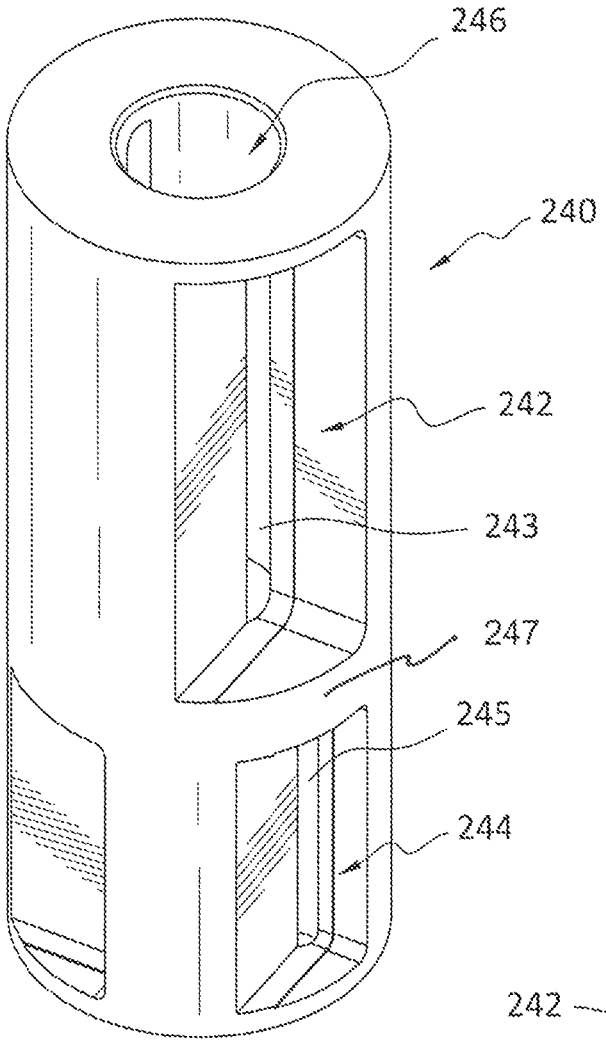
FIG. 32 is a perspective view of another embodiment of an anchor.
Figure 33:
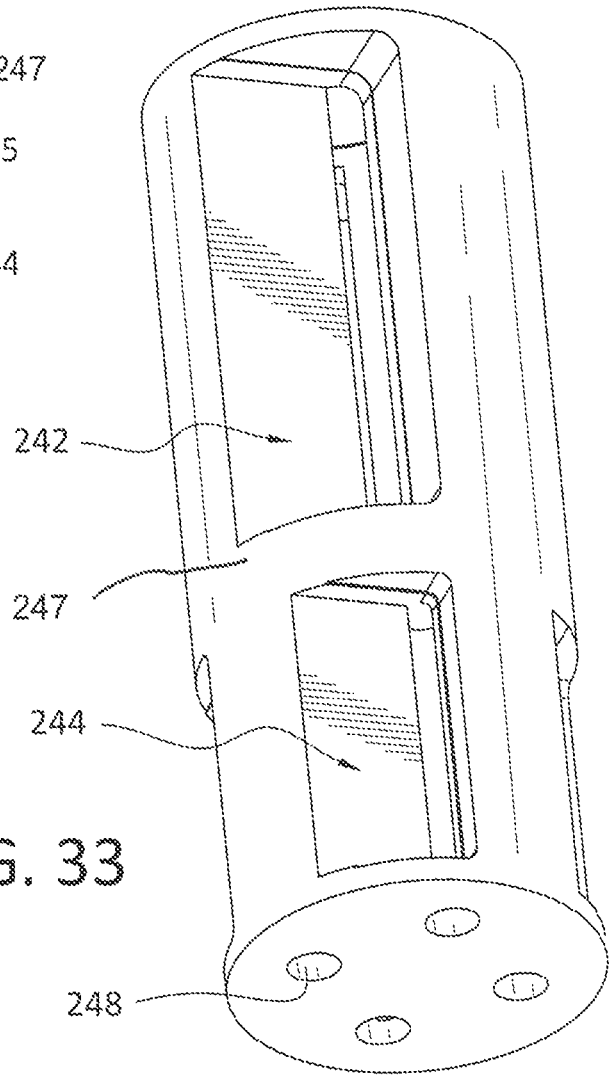
FIG. 33 is a lower perspective view of FIG. 32.

Referring to FIGS. 32-33, another embodiment of an anchor 240 is disclosed. Anchor 240 may include a first lengthwise hole 246 and longitudinally offset hole 248. A first longitudinal cutout 242 provides an opening or window 243 into the hole 246. Similarly, a cutout 244 provides an opening or window 245 into a hole 248. Referring to FIG. 33, one or more holes 248 may be provided in a lower portion of anchor 240, as shown. The cutouts 242 and 244 are configured in the same way as the cutouts 26 and 28 to provide respective guides for welding the respective rebars inserted in the respective holes 246 and 248 to the anchor 240. A divider wall 247 is provided between the first cutout 242 and the second cutout 244. Each cutout 244 is associated with a respective hole 248.

Figure 34:
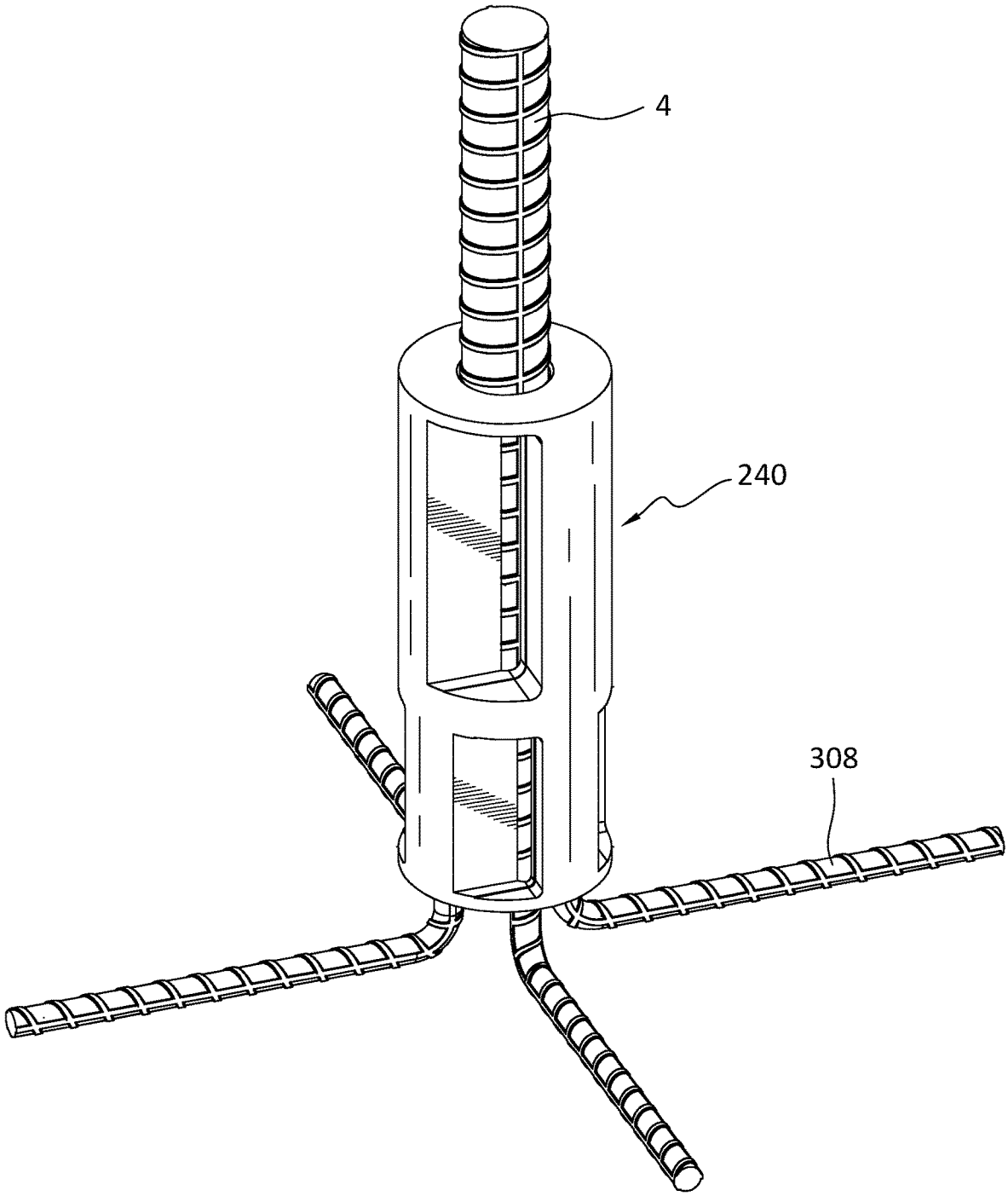
FIG. 34 is a perspective view of the anchor of FIG. 32 with rebars attached.
Figure 35:
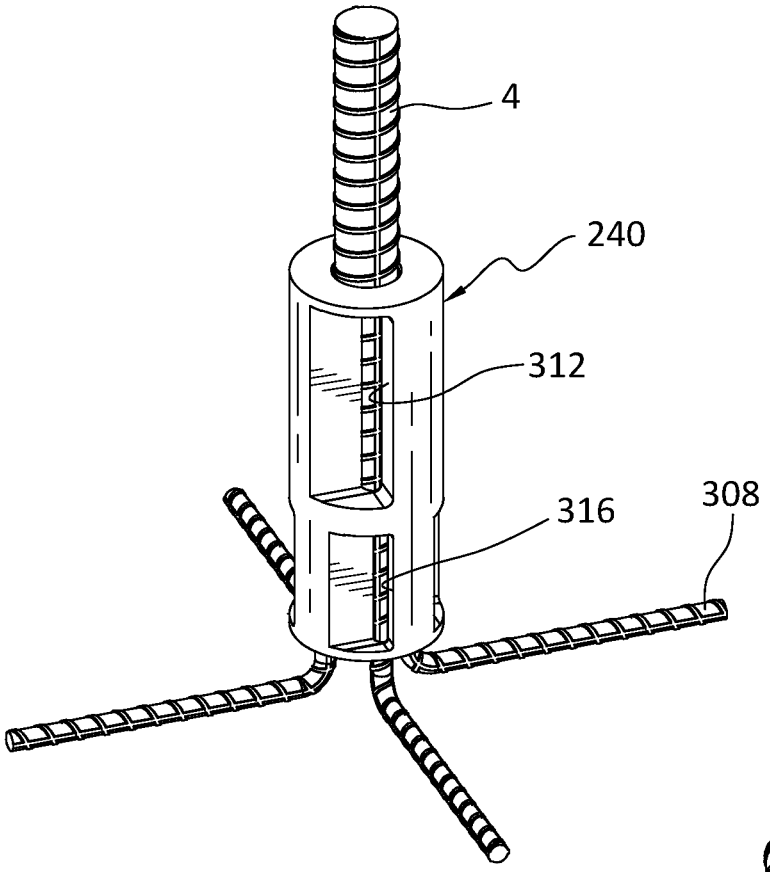
FIG. 35 is a perspective view of FIG. 32.
Figure 36:
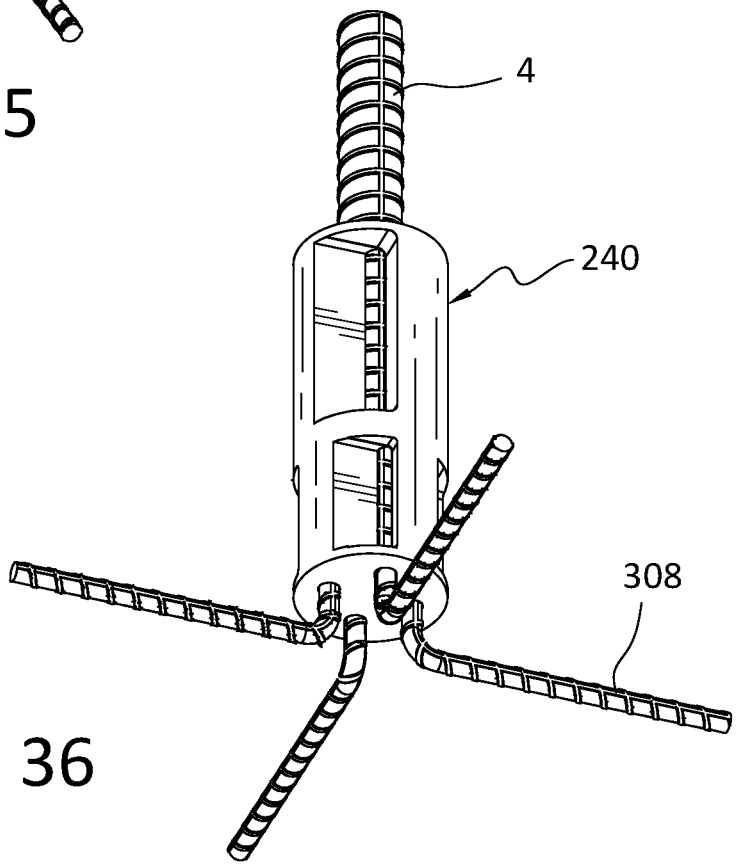
FIG. 36 is a lower perspective view of FIG. 35.

Referring to FIGS. 34-36, the anchor 240 is shown with rebar 4, with a portion 312, which is visible through the respective windows 243, to be welded to the adjacent areas of the anchor. One or more additional rebars 308 are inserted in lower holes 248 with portions 316, which are visible through the windows 245, to be welded to the anchor. In use, the anchor 240 with the attached rebars 4 and 308 is embedded in the concrete structure 6. The rebar 4 extends outside the concrete for attachment to another rebar or threaded rod, which is then attached to another structure of the building. The rebars shown may also be a threaded rod, smooth rod, hexagonal rod or any type of rod.

It should be understood that the various embodiments of the anchor shown herein may be made with a different cross-sectional shapes, such as the hexagonal shape 74 shown in FIG. 6.

While this invention has been described as having preferred design, it is understood that it is capable of further modifications, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An anchor for being embedded in concrete, comprising:

a) a body having a first end and a second end, with a first collar portion and a second collar portion, respectively;

b) the body having a side wall between the first end and the second end;

c) the body including an axial blind hole extending from the first end to an interior portion of the body, the axial hole for receiving an end portion of a rod; and d) the body including a first longitudinal cutout extending into the side wall to create a first opening into a first portion of the axial hole to expose an end portion of the rod to be inserted in the axial hole to be welded to the body, the first longitudinal cutout extending along a direction of the axial hole.

2. The anchor as set forth in claim 1, wherein the body includes a second longitudinal cutout extending into the side wall to create a second opening into a second portion of the axial hole to expose the end portion of the rod to be welded to the body.

3. The anchor as set forth in claim 1, wherein the second end includes a flange.

4. The anchor as set forth in claim 3, wherein the second end includes a support.

5. The anchor as set forth in claim 4, wherein the support is detachably attached.

6. The anchor as set forth in claim 4, wherein a hole is provided in the flange.

7. The anchor as set forth in claim 6, wherein the hole is threaded.

8. The anchor as set forth in claim 3, wherein the flange has a hexagonal shape.

9. The anchor as set forth in claim 3, wherein the flange has a cylindrical shape.

10. The anchor as set forth in claim 3, wherein threads are provided on an exterior of the flange.

11. The anchor as set forth in claim 1, wherein a) the body is cylindrical with an outer diameter; and b) threads are provided on a portion of the outer diameter of the body.

12. The anchor as set forth in claim 1, wherein:

a) the second end includes an offset hole; and b) the body includes a second longitudinal cutout extending into the side wall to create a second opening into the offset hole to expose an end portion of a rod to be inserted in the offset hole to be welded to the body.

13. The anchor as set forth in claim 3, wherein a divider is provided between the first longitudinal cutout and the second longitudinal cutout.

14. The anchor as set forth in claim 13, wherein the second longitudinal cutout is shorter than the first longitudinal cutout; and the first longitudinal cutout extends further into an interior of the body.

15. The anchor as set forth in claim 1, wherein the body is cylindrical.

16. The anchor as set forth in claim 1, wherein the body is hexagonal in cross-section.

17. An anchor for being embedded in concrete, comprising:

a) a body having a first end and a second end;

b) the body having a side wall between the first end and the second end;

c) the body including an axial hole extending from the first end into the body, the axial hole for receiving an end portion of a first rod;

d) the body including a first longitudinal cutout extending into the side wall to create a first opening into a first portion of the axial hole to expose an end portion of the first rod to be inserted in the axial hole to be welded to the body, the first longitudinal cutout extending along a direction of the axial hole;

e) the second end including an offset hole; and b) the body includes a second longitudinal cutout extending into the side wall to create a second opening into the offset hole to expose an end portion of a second rod to be inserted in the offset hole to be welded to the body.

18. An anchor for being embedded in concrete, comprising:

a) a body having a first end and a second end, with a first collar portion and a second collar portion, respectively;

b) the body having a side wall between the first end and the second end;

c) the body including an axial hole extending from the first end into the body, the axial hole for receiving an end portion of a rod, the second end including a flange extending outwardly, the flange being homogenous with the body; and d) the body including a first longitudinal cutout extending into the side wall to create a first opening into a first portion of the axial hole to expose an end portion of the rod to be inserted in the axial hole to be welded to the body, the first longitudinal cutout extending along a direction of the axial hole.

19. An anchor for being embedded in concrete, comprising:

a) a body having a first end and a second end;

b) the body having a side wall between the first end and the second end;

c) the body including an axial hole extending from the first end into the body, the axial hole for receiving an end portion of a rod;

d) the body including a first longitudinal cutout extending into the side wall to create a first opening into a first portion of the axial hole to expose an end portion of the rod to be inserted in the axial hole to be welded to the body, the first longitudinal cutout extending along a direction of the axial hole; and e) the second end including a bottom wall with a stud attached to or integral with the bottom wall, the stud for attaching to a support, the bottom wall being homogeneous with the body.

* * * * *